US008190076B2

(12) United States Patent
Omata

(10) Patent No.: US 8,190,076 B2
(45) Date of Patent: May 29, 2012

(54) IMAGE FORMING USING A TRANSPARENT TONER IMAGE

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 481 days.

(21) Appl. No.: 12/424,877

(22) Filed: Apr. 16, 2009

(65) Prior Publication Data

US 2009/0263148 A1 Oct. 22, 2009

(30) Foreign Application Priority Data

Apr. 22, 2008 (JP) ..... 2008-110844
Mar. 2, 2009 (JP) ..... 2009-047859

(51) Int. Cl.
*G03G 15/01* (2006.01)
*G03G 15/20* (2006.01)

(52) U.S. Cl. ..... 399/341; 399/231

(58) Field of Classification Search ..... 399/341
See application file for complete search history.

(56) References Cited

U.S. PATENT DOCUMENTS

2005/0135851 A1* 6/2005 Ng et al. ..... 399/341
2005/0169680 A1* 8/2005 Ng et al. ..... 399/341
2006/0051114 A1* 3/2006 Ng ..... 399/53
2006/0133870 A1* 6/2006 Ng et al. ..... 399/341
2006/0188301 A1* 8/2006 Ng et al. ..... 399/341
2006/0275058 A1* 12/2006 Omata ..... 399/302
2006/0285890 A1* 12/2006 Ng ..... 399/329
2007/0287082 A1* 12/2007 Ng ..... 430/47.5
2009/0123204 A1* 5/2009 Ng et al. ..... 399/341
2009/0238616 A1* 9/2009 Ciaschi ..... 399/341
2009/0286177 A1* 11/2009 Tyagi et al. ..... 430/124.1
2010/0150620 A1* 6/2010 Ng et al. ..... 399/321

FOREIGN PATENT DOCUMENTS

JP 2002-318482 10/2002

* cited by examiner

*Primary Examiner* — David Gray
*Assistant Examiner* — David Bolduc
(74) *Attorney, Agent, or Firm* — Fitzpatrick, Cella, Harper & Scinto

(57) ABSTRACT

A transparent toner image forming device forms a transparent toner image on a sheet on which a color toner image is fixed. Image information that is designated by a user for forming the transparent toner image on part of the sheet is obtained. Application of the transparent toner is controlled such that, when the color toner is fixed in an amount not less than a predetermined first amount per unit area in a first region designated so as not to form the transparent toner image on the basis of image information, the transparent toner image is formed in a predetermined second amount per unit area in the first region. The transparent toner image is formed in an amount not less than the predetermined second amount per unit area in a second region designated so as to form the transparent toner image on the basis of the image information.

5 Claims, 16 Drawing Sheets

IMAGE FORMING USING A TRANSPARENT TONER IMAGE

FIELD OF THE INVENTION AND RELATED ART

The present invention relates to a control apparatus for controlling an image forming portion for effecting partial adjustment of image gloss by using transparent toner and relates to a recording medium in which a program is stored.

An image forming system for forming an image by using clear toner as the transparent toner in addition to yellow toner, magenta toner, cyan toner, and black toner as colored toner (hereinafter inclusively referred to as "color toner") has been conventionally proposed. This is attributable to an increasing market demand for enhancing the appearance of an output image by partly adjusting glossiness of the output image. Specifically, this demand is such that additional information in terms of gloss, such as a water mark, an eye-catcher, or a security mark, is desired to be embedded in a part of an image by partly placing a clear toner image on a color toner image. Japanese Laid-Open Patent Application (JP-A) 2002-318482 employs such a method that a final image is formed by forming a color toner image on a sheet, once fixing the color toner image, forming a clear toner image on the color toner image, and then fixing the clear toner image. This is because a fixing performance of a fixing device exceeds its limit when both of the color toner image and the clear toner image are intended to be fixed simultaneously.

However, according to study of the present inventor, it has been found that there is a possibility of an occurrence of image defect described below when the partial adjustment of the image gloss by using the image forming method described in JP-A 2002-318482. Specifically, when the clear toner image was partly formed after the color toner image was formed and was then subjected to the fixing process and then the clear toner image was subjected to the fixing process, the image defect occurred in an area of the color toner image in which the clear toner image was not formed. This image defect was uneven glossiness with graininess of about 0.1 to 3 mm. Such a phenomenon may be attributable to a small amount of air, which has entered a fixing nip, interposed between a fixing roller and toner to prevent contact between the fixing roller and the toner. This air is an air portion enclosed when a smooth fixing roller is pressed against an uneven surface of the toner image. More specifically, when unfixed toner is fixed, the air can escape from a gap of the unfixed toner, so that there is no problem in a first fixing step. However, in a second fixing step, the image which has already been fixed in the first fixing step is placed in a smooth state to some extent. For this reason, it is considered that the air cannot escape from the gap of unfixed toner to cause the image defect.

SUMMARY OF THE INVENTION

A principal object of the present invention is to provide a control apparatus for controlling an image forming portion so that an occurrence of image defect at a portion at which a transparent toner image is not formed in the case where partial adjustment of image gloss is effected by forming the transparent toner image in a part of an image area of a sheet which has been subjected to image heating can be suppressed.

Another object of the present invention is to provide a recording medium storing a program for controlling the image forming portion in the above-described manner.

According to an aspect of the present invention, there is provided a control apparatus for controlling an image forming system, wherein the image forming system includes a transparent toner image forming device configured to form a transparent toner image on a sheet on which a color toner image has been fixed and includes a fixing device configured to fix the transparent toner image formed on the sheet, the control apparatus comprising:

obtaining means for obtaining information of a first part of a color toner image area on which transparent toner is to be applied with a first amount per unit area after the color toner image is fixed; and control means for controlling the transparent toner image forming device to apply the transparent toner, with a second amount per unit area, on a second part of the color toner image area which is the color toner image area excluding the first part, after the color toner image is fixed, wherein the second amount is smaller than the first amount.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the following embodiments, in order to measure gloss (glossiness) of a toner image fixed on a sheet and gloss of the sheet, a handy-type glossimeter ("PG-1M", mfd. by Nippon Denshoku Industries Co., Ltd.) was used according to JIS Z8741 (specular glossiness measuring method).

Embodiment 1

Hereinbelow, an image forming system including an image forming portion capable of forming a transparent toner image on a part of a sheet on which a color toner image has been fixed will be described. In this embodiment, the image forming system used for description is a tandem-type full-color electrophotographic image forming system. This image forming system is a multi-function machine having functions of a copying machine, a printer and facsimile machine.

[Image Forming Station]

First, an image forming station as an image forming portion for forming an unfixed toner image on the sheet and a laser scanning mechanism will be described.

Figure 1:
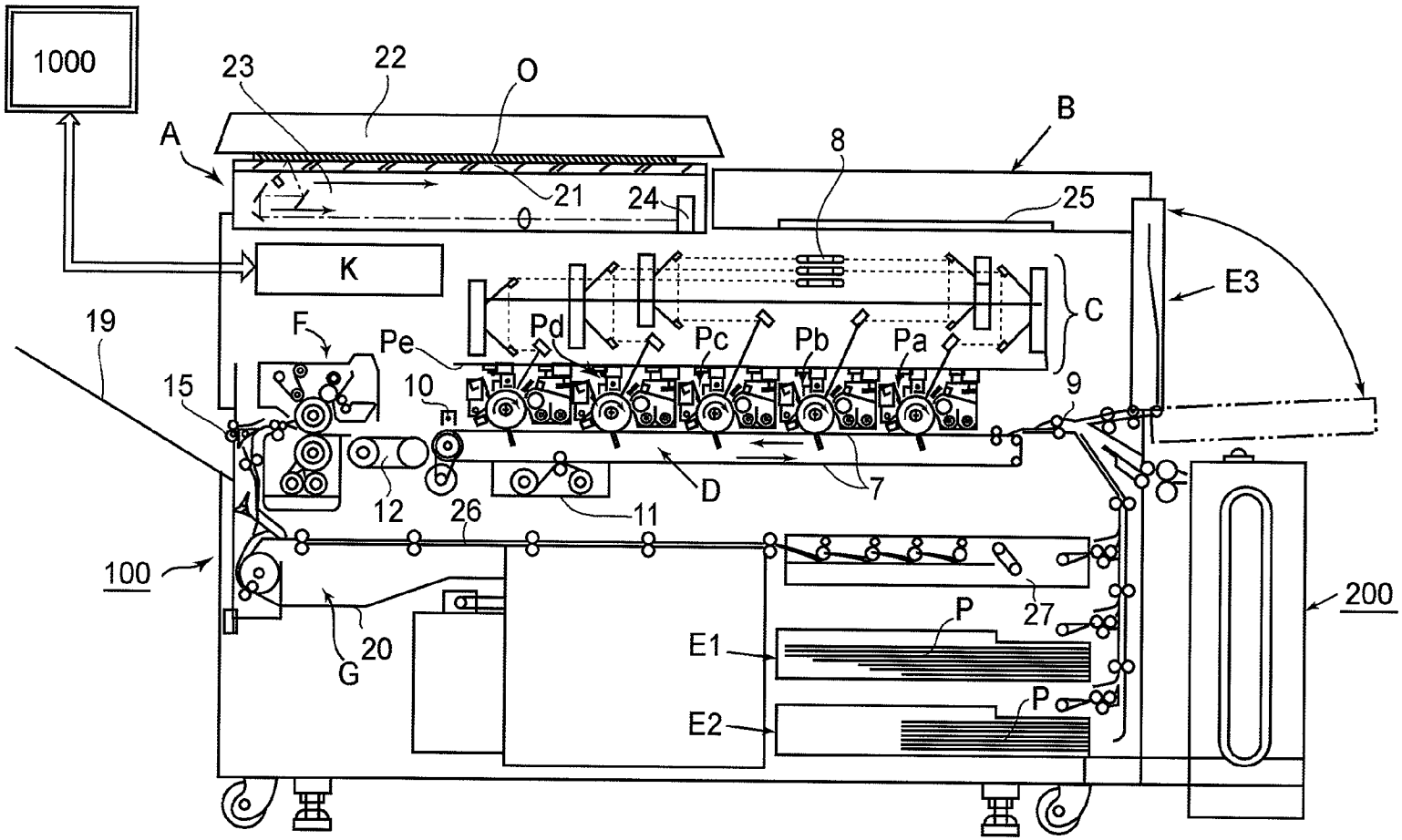
FIG. 1 is a schematic view for illustrating a structure of an image forming system according to an embodiment of the present invention.
Figure 4:
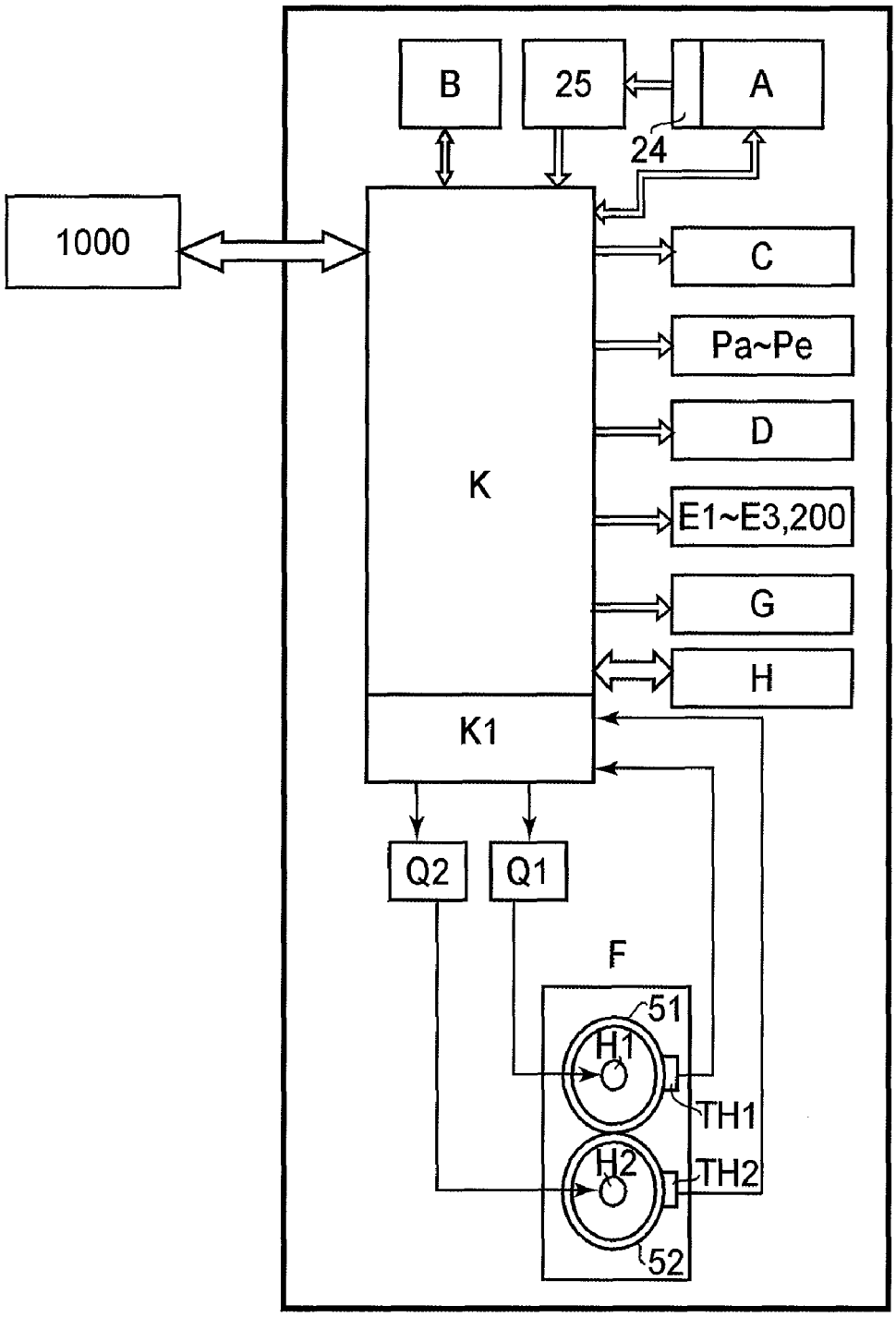
FIG. 4 is a block diagram showing a schematic structure of a control apparatus according to the embodiment of the present invention.

FIG. 1 is a schematic view showing a structure of the image forming system in this embodiment. FIG. 4 is a block diagram showing a schematic structure of a controller as a control apparatus for controlling the image forming system in this embodiment.

In FIG. 1, a reference numeral 100 represents the image forming system (hereinafter referred to as an "apparatus main assembly"). A reference numeral 200 represents a large-volume sheet feeding unit provided adjacent to the apparatus main assembly 100. This large-volume sheet feeding unit 200 is configured as an optional device used in combination with the apparatus main assembly 100. A reference symbol K represents the controller (a control circuit portion, a control board portion) as the control apparatus for controlling respective portions of the image forming system. A reference numeral 1000 represents an external input device (an external host device) such as a personal computer (PC) or a facsimile machine (device). The external input device is electrically connected to the controller K through an interface (an ethernet interface (I/F) in this embodiment). In this embodiment, the description is made by using the image forming system as an example but the control of the image forming system may also be performed by the external input device. In this case, a combination of the image forming system and the external input device is referred to as an "image forming system".

Inside the apparatus main assembly 100, a plurality of electrophotographic image forming stations is provided. In FIG. 1, in a right-left horizontal direction, first to fifth electrophotographic image forming stations Pa, Pb, Pc, Pd and Pe are disposed.

In FIG. 1, a reference symbol A represents an original reading portion (an image scanner) provided on an upper surface of the apparatus main assembly. A reference symbol B represents an operation panel provided on the upper surface of the apparatus main assembly. The original reading portion A optically scans an original O placed on an original supporting platen glass 21 to effect color-separation photoelectric reading of an original image. The operation panel B performs command input by an operator, notification of an apparatus state to the operator, and the like.

In FIG. 1, a reference symbol C represents a laser scanning mechanism (a laser scanner) including a plurality of optical scanning means provided above the above-described first to fifth image forming stations Pa, Pb, Pc, Pd, and Pe. In this embodiment, the laser scanning mechanism subjects a photosensitive drum of each of the image forming stations to light on the basis of image defect stored in a memory H. A reference symbol D represents a transfer belt mechanism provided under the first to fifth image forming stations Pa, Pb, Pc, Pd, and Pe. Reference symbols E1 and E2 represent a first sheet feeding cassette and a second sheet feeding cassette, respectively, provided below the transfer belt mechanism D in a two-tiered form with respect to a direction of gravitational force.

A reference symbol E3 represents a manual sheet feeding tray (a manual sheet feeding portion). The manual sheet feeding tray E3 can be retracted as indicated by a solid line during retraction. Further, the manual sheet feeding tray E3 can be used in a state indicated by a dotted line during use. A reference symbol F represents a fixing device provided downstream of the transfer belt mechanism D with respect to a sheet feeding (conveying) direction. Then, the respective portions of the image forming station will be described in detail.

[Electrophotographic Process Mechanism and Transfer Belt Mechanism D]

Figure 2:
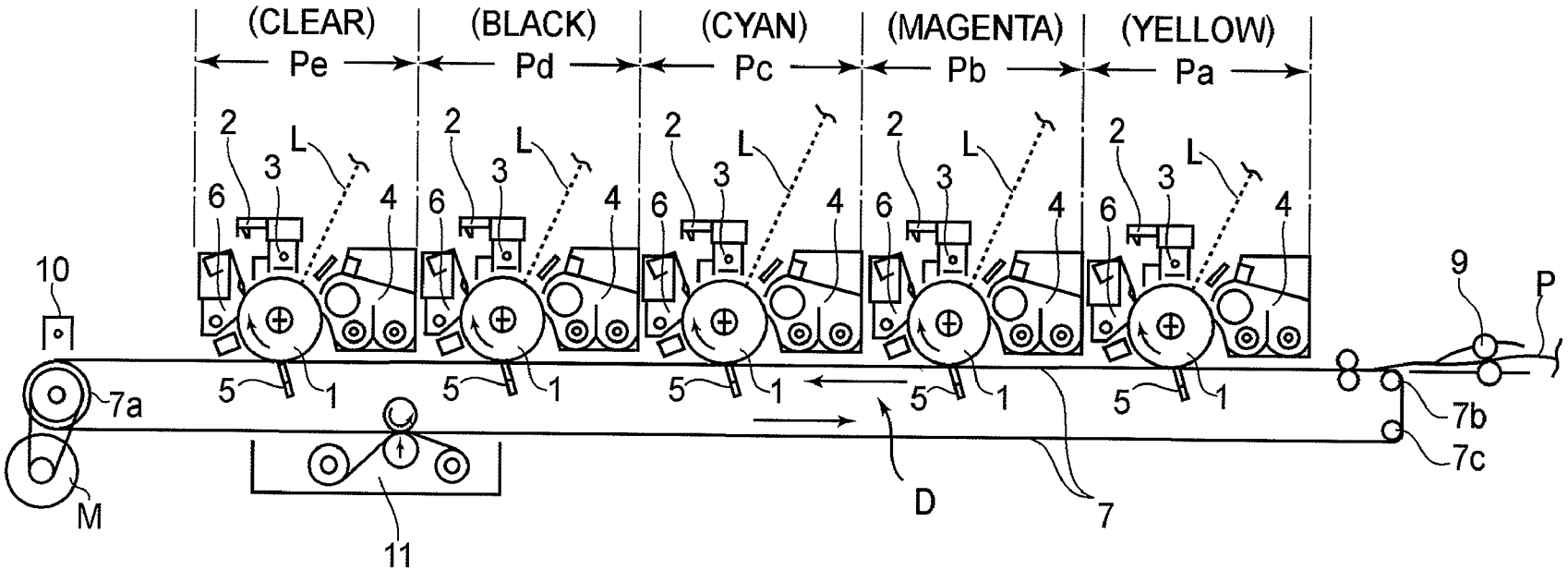
FIG. 2 is an enlarged view of an image forming station.

FIG. 2 is an enlarged view of the first to fifth image forming stations Pa, Pb, Pc, Pd and Pe and the transfer belt mechanism D.

The first to fifth image forming stations Pa, Pb, Pc, Pd, and Pe are the same electrophotographic process mechanism. That is, each of the image forming stations includes an electrophotographic photosensitive drum 1 as an image bearing member. Further, each of the image forming stations includes process means acting on the drum 1 such as a whole surface exposure lamp (a discharging lamp) 2, a primary charger 3, a developing device 4, a transfer charger 5, a drum cleaner 6, and the like.

To the developing device 4 for the first image forming station Pa as a color toner image forming means, color toner of yellow (Y) is supplied from a supplying device. To the developing device 4 for the second image forming station Pb as the color toner image forming means, color toner of magenta (M) is supplied from the supplying device. To the developing device 4 for the third image forming station Pc as the color toner image forming means, color toner of cyan (C) is supplied from the supplying device. To the developing device 4 for the fourth image forming station Pd as a color toner image forming means (device), color toner of black (Bk) is supplied from a supplying device. To the developing device 4 for the fifth image forming station Pe as a transparent toner image forming means (device), clear toner of transparent (T) (clear toner) is supplied from the supplying device.

The transfer belt mechanism D includes an endless transfer belt 7, a driving roller 7*a*, and turn rollers 7*b* and 7*c*. The transfer belt 7 is extended and stretched around the driving roller 7*a* and the turn rollers 7*b* and 7*c*. The transfer belt 7 is rotationally driven in a counterclockwise direction indicated by arrows at a predetermined speed by rotationally driving the driving roller 7*a* by a driving motor M through a power transmission device such as a timing belt device or the like. The transfer belt 7 is constituted by a dielectric resin material sheet such as a polyethylene terephthalate sheet (PET sheet), a polyvinylidene fluoride sheet, or a polyurethane sheet. End portions of the sheet are superposed on and connected to each other in an endless shape to be used. Alternatively, a belt having no seam (a seamless belt) is used.

[Fixing Device F]

Figure 3:
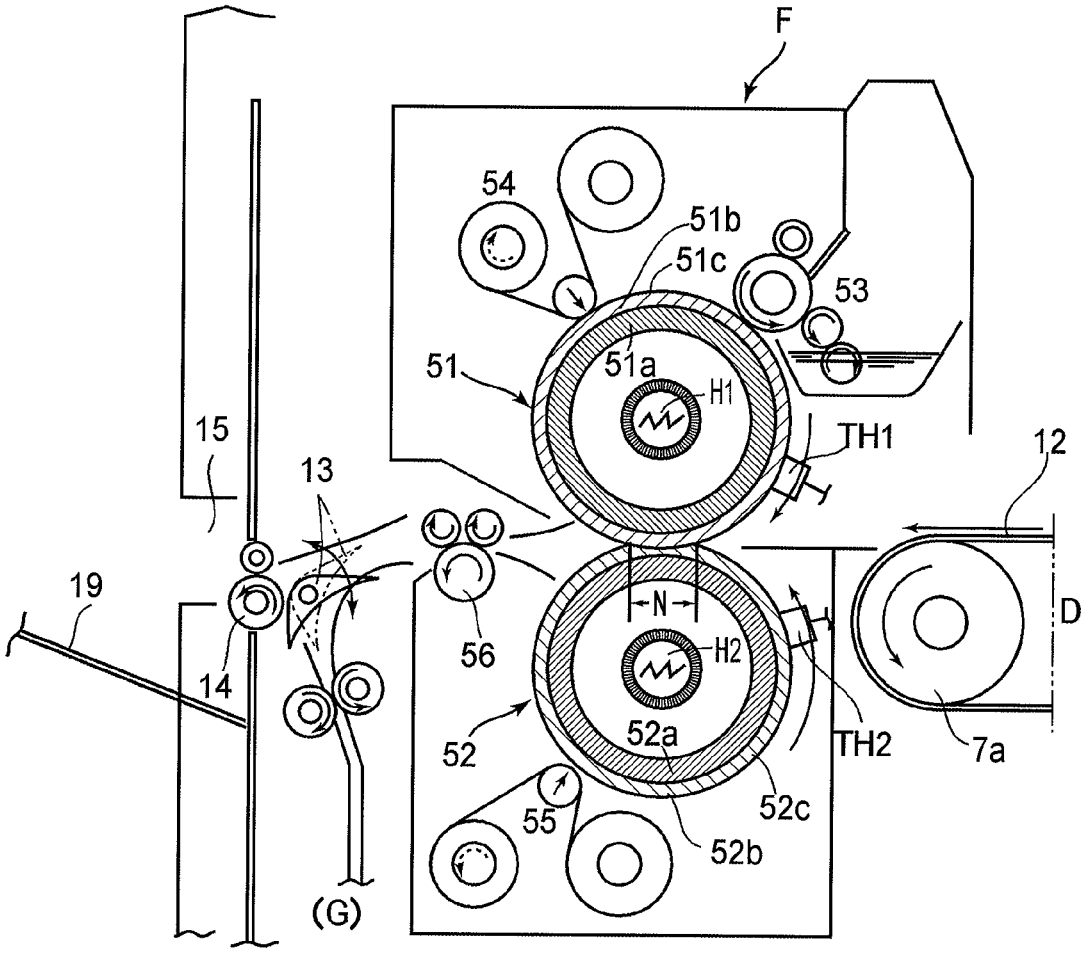
FIG. 3 is an enlarged view of a heating roller fixing device.

The heating roller fixing device F will be described with reference to FIG. 3. Reference numerals 51 and 52 in FIG. 3 represent a fixing roller (a fixing member) and a pressing roller (a pressing member), respectively, which are a rotatable member which has been rotatably supported by bearings. These fixing roller 51 and pressing roller 52 are vertically arranged in parallel and press-contact each other to form a fixing nip N.

In this embodiment, the fixing roller 51 has a concentric three-layer structure and includes a core portion 51*a*, an elastic layer 51*b*, and a parting layer 51*c*. The core portion 51*a* is constituted by an aluminum-made hollow pipe having a diameter of 44 mm and a thickness of 5 mm. Inside the hollow pipe of the core portion 51*a*, a heater H1 constituted by a halogen lamp as a heat source (a roller heating heater) is provided. The elastic layer 51*b* is constituted by a silicon rubber layer having a JIS-A hardness of 50 degrees and a thickness of 2.5 mm. The parting layer 51*c* is constituted by a 50 μm-thick PFA layer.

The pressing roller 51 also has, similarly as in the above-described fixing roller 51, the three-layer structure including a core portion 52*a*, an elastic layer 51*b*, and a parting layer 52*c*. Inside the hollow pipe of the core portion 52*a*, a heater 2 constituted by the halogen lamp as the heat source (the roller heating heater) is provided. However, the elastic layer 52*b* is formed of silicon rubber in a thickness of 3 mm. This is because a width of the fixing nip N is ensured.

The fixing roller 51 and the pressing roller 52 press-contact each other with a predetermined urging (pressing) force to form the fixing nip N, as a heat pressing portion, with a predetermined width with respect to a sheet conveying direction. The pressing force in this embodiment is 294 N (30 kgf) in terms of total pressure. In this case, the width of the fixing nip N was 7 mm.

The fixing roller 51 and the pressing roller 52 are rotationally driven by a driving motor (not shown) in directions of indicated arrows in FIG. 3 while press-contacting each other. The heaters H1 and H2 are supplied with electric power from power source circuits Q1 and Q2 (FIG. 4), respectively to generate heat. The fixing roller 51 and the pressing roller 52 are heated from the insides thereof by the heat generation of the heaters H1 and H2, respectively. In this embodiment, an 800 W heater was used as the heater H1 and a 500 W heater was used as the heater H2. Surface temperatures of the fixing roller 51 and the pressing roller 52 are monitored by temperature sensors TH1 and TH2 such as a thermistor or the like, brought into contact with the fixing roller 51 and the pressing roller 52, respectively. The temperature sensors TH1 and TH2 detect the surface temperatures of the fixing roller 51 and the pressing roller 52, respectively, and input electrical information on the temperatures into a fixing control portion K1 (FIG. 4) of the controller K.

The fixing control portion K1 controls electric power supply from the upper source circuits Q1 and A2 to the heaters H1 and H2 so that the respective surface temperatures (fixing temperatures) are kept at predetermined control temperatures (target temperature). That is, the fixing roller 51 and the pressing roller 52 are temperature-controlled at the predetermined control temperatures, so that the temperature in the fixing nip N is controlled.

A reference numeral 52 in FIG. 3 represents a parting material applicator for applying dimethyl silicone oil or the like as a parting material onto the surface of the fixing roller 51. A reference numeral 54 in FIG. 3 represents a web-type cleaning device for cleaning the surface of the fixing roller 51 by wiping. A reference numeral 55 represents a web-type cleaning device for cleaning the surface of the pressing roller 52 by the wiping. The web for the cleaning device 55 is a heat-resistant cleaning member.

As described above, the fixing roller 51 and the pressing roller 52 are rotationally driven by the external driving force. Further, the heaters H1 and H2 are controlled by the fixing control portion K1 to temperature-control the surface temperatures of the rollers to the control temperatures.

In such a state, a conveying belt 12 of the transfer belt mechanism D guides a sheet P, on which the unfixed toner image has been formed, into a fixing device F. As a result, the sheet P entering the fixing nip N is heated and pressed by the fixing roller 51 and the pressing roller 52. Thus, multiple toner images of four colors of yellow, magenta, cyan and black are melt-mixed and fixed on the surface of the sheet P as a full-color image. The sheet P coming out of the fixing nip N is separated from the fixing roller 51 or the pressing roller 52 by a separation claw (not shown).

The parting material applicator 53 applies the silicone oil onto the surface of the fixing roller 51. As a result, the toner on the sheet P having passed through the fixing nip N is less liable to deposit on the surface of the fixing roller 51. The cleaning devices 54 and 55 remove the toner offset on the surfaces of the fixing roller 51 and the pressing roller 52, respectively. A maximum amount per unit area of the toner which can be fixed on the sheet at one time by the fixing device in this embodiment is 2.1 mg/cm$^2$.

[Toner]

The toner used in this embodiment will be described. In this embodiment, as a base material (a binder) for the color toners, a polyester resin material was used. As a color toner manufacturing method, a pulverization method was used. As the toner manufacturing method, it is also possible to use a suspension polymerization method, an interfacial polymerization method, and a dispersion polymerization method. A toner component and the manufacturing method are not limited to those described above. The clear toner used, as the base material, the same polyester resin material as that for the color toner. The clear toner was manufactured without mixing a color pigment, different from the case of the color toners.

As the base material (binder) for the color toners, the polyester resin material having a glass transition point (temperature) (Tg) of 45° C. to 60° C. is generally used. The clear toner is not necessarily be transparent. For example, the clear toner used in this embodiment is white in an unfixed state. This is because the clear toner is pulverized so as to provide a particle size of about 5 μm to about 10 μm. As the surface of the clear toner pulverized in the particle size of about 5 μm to about 10 μm, light is scattered, so that transmitted or absorbed light is decreased in amount. For that reason, the clear toner looks white to human eyes.

The glass transition point (Tg) is not particularly limited. When the type or molecular weight of the resin material for the toner is changed, a melting property of the toner is changed. For that reason, when the toners in the same amount are fixed under the same fixing condition, different gloss values are obtained. Specifically, the gloss is liable to increase when the base material having a low glass transition point (i.e., a meltable base material) is used. Further, the gloss is liable to lower when the base material having a high glass transition point (i.e., a less meltable base material) is used.

In this embodiment, the glass transition points of the color toners and the clear toner are substantially equal to each other. However, the glass transition point of the clear toner can also be higher or lower than that of the color toners.

Further, even when the toners having the same glass transition point are used, e.g., energy provided to the toner is decreased by increasing the fixing speed, so that the gloss is less liable to increase.

[Image Scanner A]

The original reading portion A includes the original supporting platen glass 21 and an original pressing plate 22 which is openable and closable with respect to the glass 21. In the case of a copy (original reproduction) mode, a color original (or a monochromatic original) O to be copied is placed on the glass 21 with an image surface down in accordance with a predetermined placing standard and then is covered with the pressing plate 22 to be set. The pressing plate can also be constituted as an automatic original feeding device (ADF or RDF) so as to automatically feed a sheet-like original onto the glass 21.

In such a constitution, when the original O set on the glass 21 is read, a movable optical system 23 is moved along a lower surface of the glass 21. As a result, the downward image surface of the original O on the glass 21 is optically scanned. The resultant original scanning light is formed as an image on a CCD 24 which is a photoelectric conversion element (a solid-state imaging device). As a result, the CCD 24 converts the image on the surface of the original into electric signals for three primary colors of RGB (red, green, and blue). The respective signals for RGB converted by the CCD 24 are inputted into an image processing portion 25.

The signals thus-inputted from the image scanner A into the image processing portion 25 are converted into image signals for C, M, Y and K (Bk). Electrical image information (image data) converted at the image processing portion 25 is inputted into the controller K. The controller K forms a color toner image on the sheet on the basis of the inputted image data. At this time, the controller K functions as an area obtaining means for obtaining an area in which the color toner image is to be formed. Further, the controller K also functions as a color toner amount obtaining means (or a color image data obtaining means) for obtaining a pixel value corresponding to an amount per unit area of the color toner to be formed on the sheet. The signals inputted from the image scanner A can also be used for forming transparent toner image. That is, in the case where the clear image data used for forming the transparent toner image, the controller K functions as the area obtaining means for obtaining an area in which the transparent toner image to be formed. Further, the controller K also functions as a transparent toner amount obtaining means (or a clear image data obtaining means) for obtaining the pixel value corresponding to the amount per unit area of the transparent toner to be formed on the sheet.

The image signals obtained in the image scanner A are used, e.g., in a copy mode or a facsimile sending mode.

First, an operation in the copy mode will be described. A user sets a desired copy condition by the operation panel portion B in order to execute the copy mode. Thereafter, the user can execute copy by pressing a copy start key 400 shown in FIG. 5.

The controller K controls the laser scanning mechanism C on the basis of the signals inputted from the image scanner A. As a result, the laser scanning mechanism C emits laser beams to the first to fifth image forming stations Pa, Pb, Pc, Pd and Pe by using the laser beams which have been modulated correspondingly to the electric image information (the image data).

Next, an operation in the facsimile sending mode will be described. The user sets a necessary condition by the operation panel portion B in order to execute the facsimile sending mode. Thereafter, the user operates the operation panel portion B to effect the facsimile sending. As a result, similarly as in the copy mode, the electric image signals (image data) of the original obtained by the image scanner A are inputted into the controller K through the image processing portion 25. The controller K sends the inputted electrical image signals (image data) to a remote facsimile machine (device).

The printer mode and the facsimile receiving mode executable by the image forming system will be described.

In the case of the printer mode in which an image forming system operates as the printer, the electrical image signals are inputted from the personal computer as the external host device 1000 into the controller K of the apparatus main assembly 100. The controller K controls the image forming system on the basis of the inputted electrical image signals. Thus, the image forming system functions as the printer.

In the case of the facsimile receiving mode, the electrical image signals (image data) are inputted from the remote facsimile machine which is the external host device 1000 into the controller K of the image forming system main assembly 100. The controller K as the image data obtaining means controls the image forming system depending on the inputted electrical image signals (image data). Thus, the image forming system functions as a facsimile receiver.

[Color Image Data and Clear Image Data]

Hereinafter, the color image data refers the image data used for forming the color toner image on the sheet. Further, the clear image data refers to image data used for forming the clear toner image on the sheet.

The color image data will be described. The color image data is constituted by image data of four types including cyan image data, magenta image data, yellow image data, and black image data.

The cyan image data is data for designating an amount (per unit area) of the cyan toner image to be formed on the sheet by the image forming system. Similarly, the magenta image data, the yellow image data, and the black image data are data for designating corresponding amounts.

The image data for each of the colors are the same data and therefore description will be made by taking the cyan image data as an example.

In this embodiment, the cyan image data is constituted by data (a pixel value) corresponding to pixels necessary to form an image depending on a resolution (dot per inch) of the image forming system. Further, in this embodiment, a data value corresponding to one pixel is represented by 8 bits. Values which can be represented by the 8 bits are 0 to 255. For that reason, by using the 8 bits, it is possible to represent 256 gradation levels. Thus, the cyan image data refers to data aggregate, of the values (0 to 255) for representing a density for each of the pixels, corresponding to the pixels necessary to form the cyan image. For simplification, a maximum value of 255 which can be represented by the 8 bit is expressed as 100%. The image forming system changes an amount of toner to be formed on the sheet depending on an inputted value (0% to 100%). In this embodiment, when 100%-cyan image data as a value corresponding to all the pixels is inputted in the image forming system, the image forming system forms an image of the cyan toner in a weight of 0.5 g per 1 $cm^2$. Herein, the toner weight in the case where an image is formed in an area of 1 $cm^2$ is referred to as the amount per unit area of the toner.

The clear image data refers to data aggregate, of the values (0 to 255) for representing the density for each of the pixels, corresponding to the pixels necessary to form the clear image.

Incidentally, a maximum density and a maximum amount per unit area are determined depending on image design, a toner property, a fixing condition of the fixing device, the type of the sheet, and the like. For that reason, these factors are not limited to those described in this embodiment. Hereinafter, for simplification, the pixel value of image data for an image is represented by adding the pixel value of image data for a corresponding image at the same position. For example, when the pixel value of the cyan image data is 20% and a corresponding pixel value at the same position is 40%, the pixel value of the color image data is represented as 60%.

[Operation Panel Portion B and Controller K]

The operation panel portion can be subjected to the input by the user. The controller K functioning as a control apparatus for controlling the image forming system controls the image forming system depending on instructions inputted from the operation panel portion B. Further, the controller K also functions as the data obtaining means for obtaining the above-described clear image data and color image data, and the like. The controller K appropriately stores the obtained data in the memory H and uses the data for image forming system control or the like. The clear image data, the clear image data conversion table, and the like are also stored in the memory H.

Hereinbelow, the operation panel portion B which accepts user setting will be described more specifically.

[Operation Panel B]

Figure 5:
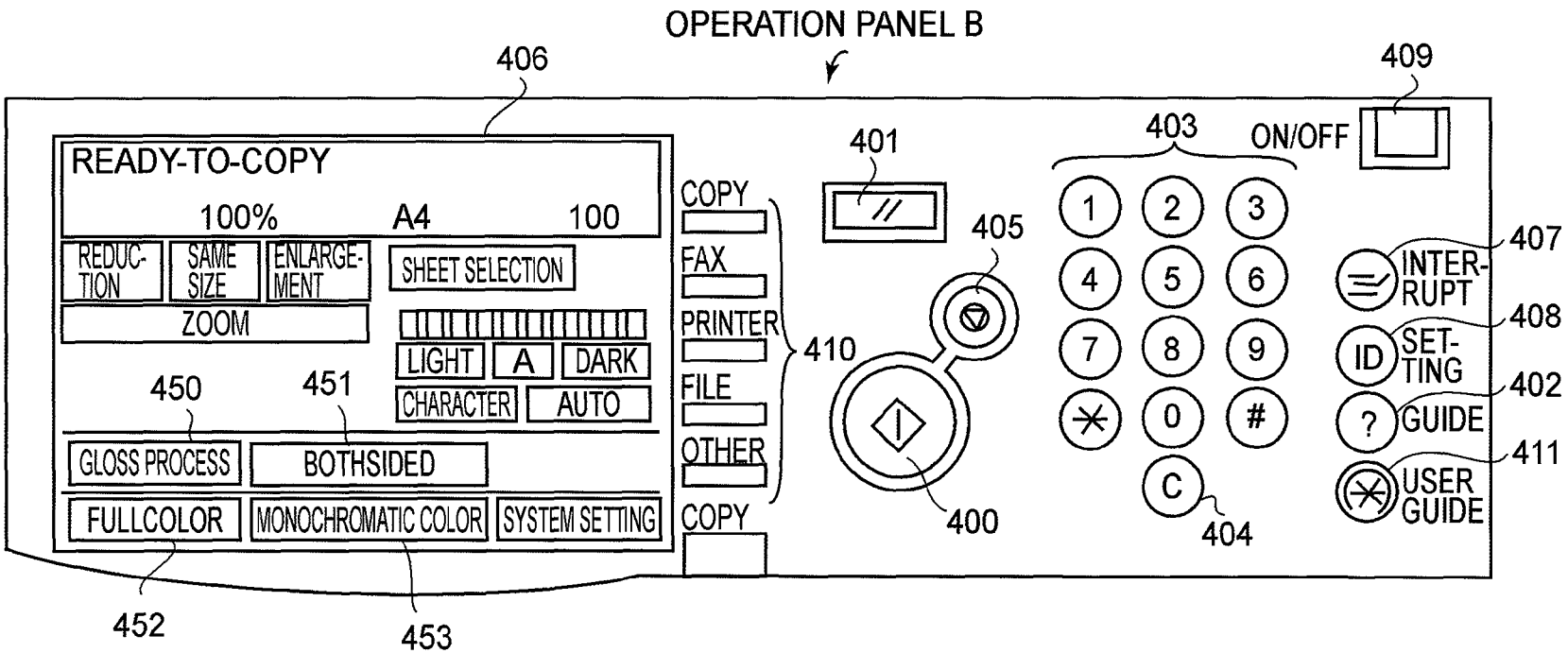
FIG. 5 is a plan view showing an example of an operation panel in the embodiment of the present invention.

FIG. 5 is a schematic view for illustrating the operation panel portion B. In FIG. 5, a reference numeral 400 represents the copy start key for providing copy start instructions to the image forming system by the user. A reference numeral 401 represents a reset key for returning a current mode to a normal mode. In this embodiment, the normal mode, setting for image formation of "monochromatic/one side/non-clear" is employed. A reference numeral 402 represents a guidance key to be pressed when a guidance function is used. A reference numeral 403 represents numeric keys for inputting numeric values such as the pre-set number of sheets and the like. A reference numeral 404 represents a clear key for clearing an inputted numeric value. A reference numeral 405 represents a stop key for stopping the copy during continuous copying. A reference numeral 406 represents a liquid crystal display of a touch panel type as a means for displaying settings for various modes and a state of the printer. A reference numeral 407 represents an interrupt key for making an emergency copy by processing the interrupt during the continuous copying or during use as the facsimile machine or the printer. A reference numeral 408 represents a personal identification key for managing the number of sheets copied by individual or division. A reference numeral 409 represents a soft switch for turning on and off an electric power source of an image forming system main assembly. A reference numeral 410 represents function keys to be used when the function of the image forming system is changed. A reference numeral 411 represents a user mode key for entering a user mode in which the user pre-sets items such as ON/OFF of auto cassette change and a change in setting time until the current mode is changed to an energy saving mode. A reference numeral 450 represents a gloss process mode (clear mode) selection key. A reference numeral 451 represents both-sided image forming mode selection key. A reference numeral 452 represents a full-color image forming mode selection key. A reference numeral 453 represents a monochromatic color image forming mode selection key. The description of the operation panel portion is as explained above. The user can provide instructions to the image forming system by operating these keys on the operation panel.

[Controller K]

The controller K functioning as a control means controls the entire image forming system depending on the user's instructions or the input from the external device.

Here, the description will be made by dividing the image form operations into the image form operation in the case where the full-color button 452 is selected (non-clear mode) and the image form operation in the case where the gloss process button 450 is selected (clear mode). First, a process executed by the controller K with respect to the inputted color data when the color image is formed will be described. Subsequently, the non-clear mode and the clear mode will be described.

[Process for Suppressing Amount Per Unit Area of Color Toner]

The image forming system effects image formation on the basis of the inputted color image data. In this case, the image forming system makes image correction such as so-called gamma correction so that a color (tone) of the inputted color image data coincides with a predetermined color (tone). The image forming system calculates the toner amount for each of pixels by using the corrected data. Then, by superposing the respective color toners, various colors are represented. In this case, theoretically, as color image information, an image data amount is 400% at the maximum (i.e., when each of image data amounts for Y, M, C and K (Bk) is 100%).

As described above, theoretically, a maximum value of color image data for one pixel is 400%. However, in actual image formation, toners with the image data value of 400% are less used. This is because the controller K changes the maximum value of the color image data for one pixel to a range from 180% to 240% by executing a method such as UCR or OGCR.

UCR refers to Under Color Removal. When a color original is subjected to four color separation, at a portion where three colors of C (cyan), M (magenta) and Y (yellow) overlap with each other, a gray component generates. UCR is a method such that the gray component is replaced with black (Bk) print and aims to decrease a total image data amount by replacing the gray component, having darkness (depth of color) equal to or more than a certain degree, with the black print.

GCR refers to Gray Component Replacement. In a color-separated image, dots having the same C (cyan)/M (magenta/Y (yellow) ratio assume black or gray. By replacing the resultant portion with K (black), a dot ratio can be decreases, so that a total dot area ratio is lowered by GCR. By employing these processes (methods), it is possible to reduce the amount of toner consumed during the image formation.

[Operation of Image Forming System in Non-Clear Mode]

A full-color image forming operation in the non-clear mode will be described. In the non-clear mode, of the first to fifth image forming stations, Pa, Pb, Pc, Pd and Pe, image formation is effected at the first to fourth image forming stations Pa, Pb, Pc and Pd as the color toner image forming means. The drum 1 for the fifth image forming station as the transparent toner image forming means is rotated but a clear toner image is not formed.

The controller K controls the first to fifth image forming stations Pa, Pb, Pc, Pd and Pe so as to be driven with predetermined timings. As a result, the drum 1 for each of the respective image forming stations is rotated in a clockwise direction of an indicated arrow in FIG. 2. Similarly, the controller K controls the transfer belt 7 of the transfer belt mechanism D so as to be rotationally driven. Similarly, the controller K drives the laser scanning mechanism. In synchronism with this drive, the primary charger 3 at each of the first to fourth image forming stations Pa, Pb, Pc and Pd electrically charges the surface of an associated drum 1 uniformly so as to have a predetermined polarity and a predetermined potential. The laser scanning mechanism C subjects the surface of each of the drums 1 for the first to fourth image forming stations Pa, Pb, Pc and Pd to laser beam scanning exposure L depending on an image signal. As a result, on the surface of each of the drums 1 for the first to fourth image forming stations Pa, Pb, Pc and Pd, an electrostatic image corresponding to the image signal is formed. Specifically, the laser scanning mechanism C subjects laser light (beam) emitted from a light source device to scanning by using a rotating polygonal mirror 8. The light beam subjected to scanning by using the polygonal mirror 8 is deflected by a reflection mirror and is condensed on a generating line of the drum 1 by the fθ lens. In this manner, the electrostatic image corresponding to the image signal is formed on each drum 1. The formed electrostatic image is developed as a toner image by the developing device 4. Here, the controller K causes the toner image forming means for each of the colors to form a desired toner image by sending the image data stored in the memory H to the laser scanning mechanism C. Hereinafter, a portion at which the toner image is formed on the sheet by receiving the image data from the controller K is referred to as an image forming portion. The image forming portion includes the image forming station and the laser scanning mechanism.

By a series of electrophotographic process operations as described above, a yellow toner image corresponding to a yellow component image for a full-color image is formed on a peripheral surface of the drum 1 for the first image forming station Pa. Similarly, a magenta toner image corresponding to a magenta component image for the full-color image is formed on the peripheral surface of the drum 1 for the second image forming station Pb. On the peripheral surface of the drum 1 for the third image forming station Pc, a cyan toner image corresponding to a cyan component image for the full-color image is formed. On the peripheral surface of the drum 1 for the fourth image forming station Pd, a black toner image corresponding to a black component image for the full-color image is formed.

A sheet-feeding roller for a sheet-feeding portion selected and designated from a large-volume sheet-feeding unit 200, a first sheet-feeding cassette E1, a second sheet-feeding cassette E2, and a manual sheet-feeding tray E3 is driven. As a result, one sheet of sheets P stacked and accommodated in the selected and designated sheet-feeding portion is separated and fed. Then, the fed sheet P is supplied onto the transfer belt 7 of the transfer belt mechanism D by a plurality of conveying rollers and a plurality of registration rollers 9.

The sheet P supplied on the transfer belt 7 is sent successively to transfer portions of the first to fifth image forming stations Pa, Pb, Pc, Pd and Pe. Each of the transfer portions of the image forming stations is a contact portion between an associated drum 1 and the transfer belt 7.

When the transfer belt 7 is rotationally driven and is confirmed that it locates at a predetermined position, the sheet P is sent from the registration rollers 9 onto the transfer belt 7 and is conveyed toward the first transfer portion of the first image forming station Pa. At the same time, an image writing signal is placed in an ON state and on the basis of the image writing signal, image formation is effected on the drum 1 for the first image forming station with predetermined timing.

Then, at the transfer portion on a lower surface side of the drum 1, the transfer charger 5 applies an electric field or electric charge, so that the yellow toner image for a first color formed on the drum 1 is transferred onto the sheet P. By this transfer, the sheet P is firmly held on the transfer belt 7 by an electrostatic attraction force and is subsequently conveyed successively to the transfer portions of the second to fourth image forming stations Pb, Pc and Pd. Then, the sheet P is subjected to successive superimposing transfer of the toner images for the respective colors of magenta, cyan and black formed on the drums for the second to fourth image forming station, respectively. As a result, unfixed four color toner images for the full-color image are synthetically formed on the sheet P. At this time, the drum 1 for the fifth image forming station Pe is rotated as described above but image formation of the clear toner image is not performed. For that reason, no transfer of the clear toner image is made at the transfer portion of the fifth image forming station Pe.

As the transfer charger 5, a contact charger was used. Further, the transfer charging means has been known that the image was stabilized by keeping a current to be applied to the transfer charging means at a constant and proper current level. Therefore, also in this embodiment, constant current control was effected so as to obtain the constant current even in the case where a volume resistivity value varies depending on the type (thickness, material, or the like) of the sheet, a moisture absorption condition, or the like.

The sheet P on which the four color toner images for the full-color image are synthetically formed is electrically discharged, by a separation charger 10 at a downstream portion of the transfer belt 7 with respect to a conveyance direction of the sheet P, to attenuate the electrostatic attraction force, so that the sheet P is separated from a terminal portion of the transfer belt 7. Particularly, the sheet P is dried in a low-humidity environment to increase an electric resistance, so that the electrostatic attraction force of the sheet P with the transfer belt 7 is increased to enhance an effect of the separation charger 10. Generally, as the separation charger 10, in order to electrically charge the sheet P in an unfixed state of the toner images, a non-contact charger is used. A reference numeral 11 in FIG. 2 represents a cleaning device for the transfer belt 7 surface.

The sheet P separated from the transfer belt 7 is guided into a fixing device F, as a fixing device configured to fix the unfixed toner images on the sheet surface, by a conveyance belt 12. In this embodiment, the fixing device F is a heating roller fixing device as shown in FIG. 3.

The sheet P guided into the fixing device F is nip-conveyed after entering a fixing nip (portion) N which is a press-contact portion between the fixing roller 51 and the pressing roller 52. As a result, the respective color toner images which are heated and pressed are subjected to color mixing to be fixed on the sheet P. The sheet P having passed through the fixing nip N is conveyed for sheet discharge by a fixing and sheet discharging roller 56. At this time, a selector 13 is switched to take a first attitude indicated by a solid line in FIG. 3. As a result, the sheet having passed through an upper side of the selector 13 is relayed to a main assembly-side sheet discharging roller 14, so that the sheet is discharged from a sheet discharge port 15 to a sheet discharge tray 19 located outside the image forming system main assembly.

In the case where the both-sided image forming mode is selected, the sheet P which has already been subjected to first side image formation and has come out of the fixing device is changed in route to a reverse re-feeding mechanism G side by the selector 13 switched to take a second attitude indicated by a chain double-dashed line in FIG. 3. As a result, the sheet P is reversed by a reversing portion (a switch back mechanism) of the reverse re-feeding mechanism G and thereafter is sent to a both-side conveying path 26 to be once accommodated in an intermediate tray 27. The sheet accommodated in the intermediate tray 27 is sent from the intermediary tray 27 toward the registration rollers 9 by the sheet-feeding rollers driven with predetermined control timing. From the registration rollers 9, the sheet is fed again onto the transfer belt 7 of the transfer belt mechanism D with a second surface placed in a faced-up state. Then, similarly as in the case of the image formation on the first surface, the synthetic formation of the four color toner images for the full-color image is carried out on the second surface by the first to fourth image forming stations Pa, Pb, Pc and Pd. The sheet P which has been subjected to the toner image formation on the second surface is separated from the transfer belt 7 and is conveyed into the fixing device F to be subjected to a fixing process of the toner images on the second surface of the sheet P.

It is also possible to effect not only the full-color image formation but also monochromatic image formation or monochromatic color (single color) image formation. When the monochromatic color image mode is selected, the image forming station, of the first to fifth image forming stations Pa, Pb, Pc, Pd and Pe, corresponding to the selected color is operated for image formation. The drums 1 for the image forming stations other than that for the selected color are rotationally driven but are not subjected to the image formation. Then, at the transfer portion for the image forming station subjected to the image forming operation, such a sequence that the toner images are transferred onto the sheet P conveyed by the transfer belt mechanism D is executed.

[Operation of Image Forming System in Clear Mode]

In this embodiment, a density of 1.8 for each of all the colors was obtained at the toner amount per unit area of 0.5 $mg/cm^2$ by using A2 gloss coated paper having a basis weight of 150 $g/m^2$. This toner amount per unit area of 0.5 $mg/cm^2$ was taken as a maximum toner amount per unit area for one color.

During the color toner image formation, a process speed was 100 mm/sec and a control temperature (target temperature) of each of the fixing roller 51 and the pressing roller 52 was 160° C.

During the clear toner image formation, the process speed was 300 mm/sec and the control temperature (target temperature) of each of the fixing roller 51 and the pressing roller 52 was 160° C.

Further, in this embodiment, as the clear toner, toner produced by using the polyester resin material, identical to that for the color toners, without mixing a color pigment. For that reason, the clear toner has the substantially same glass transition point (Tg) as that of the color toners.

However, the process speed during the clear toner image formation is higher than that during the color toner image formation, so that energy which can be provided to the clear toner is decreased. For that reason, even when the toners having the same glass transition point are used, the energy which can be provided to the clear toner is less than the energy which can be provided to the color toners. Therefore, there is a tendency that the gloss at a portion where the clear toner image is formed is lower than the gloss at a portion where the color toner images are formed. In this embodiment, in order that the clear toner is matt compared with compared with the color toners, a clear toner-formed area is made matt by positively lowering the energy at the time of the fixation during the second image formation. Specifically, as a second image forming condition, the process speed is increased to 300 mm/sec to lower an amount of heat given by the fixation, so that the gloss of the clear toner is suppressed at a low level. In this embodiment, the image forming condition and base materials for the color toners and the clear toner are selected so that the gloss at the clear toner-formed portion is low. It is also possible to use, as the base material for the clear toner, a base material having the glass transition point lower than that of the base material for the color toners. In that case, the gloss of the clear toner image which has been fixed once is higher than that of the color toner images which have been fixed twice (as described in Embodiment 4 appearing hereinafter).

[Image Forming Operation]

Next, image formation in the clear mode in which partial adjustment of the image gloss is performed by using the above-described clear toner will be described.

When the clear mode is selected, the controller K controls the image forming system so that the clear toner image is formed and is then fixed on the sheet on which the color toner images have been formed and fixed. That is, the sheet is subjected to formation and fixation of the color images for the first time and formation and fixation of the clear image for the second time. Thus, the color image formation and the clear image formation are carried out separately in two times. In this way, in the clear mode, the image forming system outputs a product by executing the toner image formation and the image heating on one of the surfaces of the sheet separately in plural times.

Specifically, first, the first to fourth image forming stations Pa, Pb, Pc and Pd carry out the first image formation on the sheet P by using the color toners. The sheet P on which the color toner images are formed are guided into the fixing device F. As a result, the color toner images are fixed on the sheet P (first fixation).

Then, the sheet P which has been subjected to the first image formation and fixation and then has come out of the fixing device F is changed in route toward the reverse re-feeding mechanism G side by the selector 13 switched to the second attitude indicated by the chain double-dashed line in FIG. 3. The sheet P entering the reverse re-feeding mechanism G side passes through the conveyance path 26 without being reversed and then is conveyed from the registration rollers 9 onto the transfer belt 7 again.

Then, the fifth image forming station Pe forms the clear toner image on the sheet P, on which the color toner images have been formed, by using the clear toner. Incidentally, after the image formation on the sheet P is effected at the fifth image forming system Pe by using the clear toner, the image formation may also be effected at the first to fourth image forming stations Pa, Pb, Pc and Pd by using the color toners. As a result, on the color toner images fixed on the sheet P which has been subjected to the first image formation and fixation, the clear toner image or the color toner images and the clear toner image are formed (second image formation). The sheet P is guided into the fixing device F again, so that the toner images formed during the second image formation are fixed on the sheet P (second fixation).

The sheet P having passed through the fixing nip N of the fixing device F is conveyed for sheet discharge by the fixing and sheet discharging roller 56. Then, in the case of the one side image forming mode, the sheet P passes through the upper side of the selector 13 and is relayed to the main assembly-side sheet discharging roller 14, so that the sheet P is discharged from the sheet discharge port 15 to the sheet discharge tray 19 located outside the image forming system main assembly.

The reverse re-feeding mechanism G controls the reversal of the sheet P by controlling the attitude of the selector 13. That is, in the case where the sheet is not reversed, the selector 13 directs the sheet toward the conveyance path 26 as it is. Further, in the case where the sheet is reversed, the selector 13 directs the sheet toward the conveyance path 26 after the sheet passes through a reverse path 20.

As described above, on a part of the color toner images fixed on the sheet, the clear toner image (transparent toner image) is formed and heated to perform the partial adjustment of the image gloss.

In this way, the clear toner image is transferred and fixed on the sheet, on which the images of the color toners have been transferred and fixed by the first image formation, by the second image formation in order to perform the partial adjustment of the image gloss. That is, the clear toner is partly laminated and fixed in an image area of the sheet to perform the partial adjustment of the image gloss. For this purpose, as a toner concentration of the clear toner image, the toner amount per unit area providing a desired glossiness is set. Incidentally, it is not necessary that the maximum amount per unit area of the clear toner coincides with that of the color toners, so that the toner amount per unit area capable of providing a desired gloss may be taken as the maximum amount per unit area of the clear toner.

[Relationship Between Toner Amount and Glossing Image Formation Condition]

In this embodiment, the gloss is partly adjusted by using the clear toner. Based on the above-described relationship, in this embodiment, the clear toner image is not formed in an area (first area), in which the gloss is increased to enhance luster, of the image area of the sheet. On the other hand, in an area (second area) different from the first area, the clear toner image is formed. As a result, the gloss in the first area in which the clear toner image is not formed is high and the gloss in the second area in which the clear toner image is formed is low.

In this way, by providing a difference in gloss between in the first area and in the second area, the partial gloss adjustment of the image is performed.

Under such a condition, the relationship between the toner amount and the gloss will be described.

First, on A2 gloss coated paper (basis weight=150 g/m$^2$), the color toner images are uniformly formed with the color image data value of 200% (the toner amount per unit area=1.0 mg/cm$^2$). When the color toner images are fixed at a portion on the sheet under a condition including the target temperature of 160° C. and the process speed of 100 mm/sec and are further fixed under a condition including the target temperature of 160° C. and the process speed of 300 mm/sec, the gloss at the portion is 45% (60 degree-gloss measurement).

On the A2 gloss coated paper (basis weight=150 g/m$^2$), the color toner images are uniformly formed with the color image data value of 200% (the toner amount per unit area=1.0 mg/cm$^2$). On the color toner images, when the clear toner image is uniformly formed with the clear image data value of 100% (the toner amount per unit area=0.5 mg/cm$^2$) and is fixed at a portion on the sheet under the condition including the target temperature of 160° C. and the process speed of 300 mm/sec, the gloss at the portion is 10% (60 degree-gloss measurement).

Incidentally, for the gloss measuring method, a handy glossimeter ("PG-1M", mfd. by Nippon Denshoku Industries Co., Ltd.) was used (according to JIS Z8741: specular glossiness-measuring method).

[Problem Occurring when Conventional Method is Used]

By using the image forming method described in JP-A 2002-318482, the gloss difference can be provided.

However, in the case where partial marking is made by the clear toner as in the device described in JP-A 2002-318482, image defect occurred at a color toner portion where the image formation was not carried out by using the clear toner. That is, the image defect occurred at the color image portion where the color toner images were fixed two times without being covered with the clear toner. Specifically, the image defect was uneven glossiness such that graininess of about 0.1-3 mm was observed at the portion which was not covered with the clear toner.

As a result of much study on the cause of the uneven glossiness, it was found that the cause was a small amount of air entering the fixing nip. That is, it was found that the small amount of air entering the fixing nip was nipped between the fixing roller and the fixed toners to obstruct the contact between the fixing roller and the fixed toner surface. Further, when the fixing temperature was increased, it was also found that the air caused the image defect of several millimeters since the air displaced the toners which sufficiently melted and were decreased in melt viscosity. This air is enclosed air at the time of pressing the smooth fixing roller against the uneven surface of the toner images.

That is, when the unfixed toners are fixed, the air can escape from a gap between the unfixed toners but when the two-time fixing method is used, the air cannot escape from the gap since the toner surface of the toners at the time of the first fixation is smooth, thus causing the image defect.

[Clear Mode for Suppressing Occurrence of Image Defect]

The present inventor has focused attention on that the air can escape from the gap between the unfixed toners when the unfixed toners are fixed and that such image defect does not occur on marking of the clear toner fixed at the time of the second fixation. To this end, the present inventor has found that the image defect is remedied by placing a small amount of the clear toner, during the second image formation and fixation using the clear toner, on the color toner images fixed at the time of the first fixation.

That is, in an amount in which the gloss is to be increased intrinsically with no transfer of the clear toner, by transferring a small amount of the clear toner to such a degree that the gloss is not substantially increased, the above-described air is caused to escape from the gap between the unfixed clear toner particles, so that the occurrence of the image defect is suppressed.

Here, the gloss Gs of an output image with respect to image data in the case where the color toner images are fixed with the color image data value of 200% by the first fixation and thereon the clear toner image is formed and fixed in the image forming system in this embodiment was measured. The gloss Gs was measured by the above-described handy glossimeter and method. The results are shown in Table 1.

TABLE 1

| *1 P.V. (%) | 0 | 10 | 20 | 30 | 40 | 50 | 60 | 70 | 80 | 90 | 100 |
|---|---|---|---|---|---|---|---|---|---|---|---|
| *2 I.D. | B | B | A | A | A | A | A | A | A | A | A |
| Gs (%) | 45 | 42 | 28 | 20 | 16 | 14 | 13 | 12 | 11 | 11 | 10 |

*1: "P.V." represents a pixel value.

*2: "I.D." represents an image defect. "A" represents that the image defect occurred. "B" represents that the image defect did not occur.

Table 1 shows the gloss values (Gs) at the clear toner-fixed portion and occurrence and non-occurrence of the image defect at the clear toner-fixed portion when the clear toner forming amount is changed in 10% increments from 0% to 100% with respect to the sheet on which the color toner images with the color image data value of 200% have been formed. Incidentally, the fixing speed of the clear toner image is 300 mm/sec. Further, the control temperature of the fixing roller and the pressing roller are both 160° C.

As is understood from Table 1, when the clear toner image was formed in the amount per unit area of 0.1 mg/cm$^2$ or more (20% or more in terms of the pixel value of the clear image data) on the sheet on which the color toner images were fixed, conspicuous image defect did not occur. As described above, the fixing speed at the time of the second fixation is slower than that at the time of the first fixation, so that the gloss value (Gs) at the clear toner-fixed portion, where the data amount (the toner amount per unit area) is increased, is decreased.

As is also understood from Table 1, in the area in which the image density level of the clear toner image is a certain level or more (in this embodiment, the pixel value of the image data is less than 20%), the amount per unit area of the unfixed clear toner is small, so that the air cannot escape by the second fixation, thus causing the image defect. In other words, it is found that the occurrence of the image defect can be suppressed by forming the clear toner image in a certain small amount (in this embodiment, 20% or more in terms of the image data pixel value) in the amount in which the clear toner image has not been formed conventionally.

From the above-described results, it was found that the occurrence of the image defect can be suppressed by converting the image data pixel value of less than 20% into the image data pixel value of 20% (or more). Incidentally, as is also understood from Embodiments described later, a threshold value of the image data at the time of the occurrence of the image defect varies depending on the image forming condition, the type of the toners, and the like. For that reason, with respect to the image forming condition and the type of the toners the image data pixel value (20% (or more) in this embodiment) is determined in consideration of various conditions in order to suppress the occurrence of the image defect. In other words, the toner amount per unit area of the clear toner image to be formed on the sheet is determined in consideration of the various conditions.

[Gloss Difference]

As described above, it has been found that the occurrence of the image defect can be suppressed by forming the clear toner image not only in the area in which the gloss is to be lowered but also in the area, in which the gloss is to be increased, in the small amount (20% or more in terms of the image data pixel value).

Figure 6:
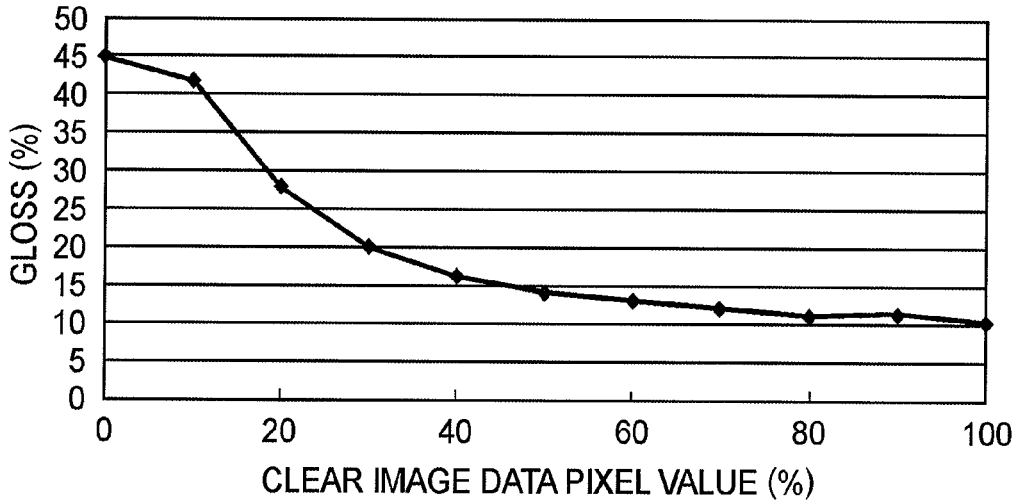
FIG. 6 is a graph showing a relationship between an amount per unit area of clear toner and gloss in the embodiment of the present invention.

FIG. 6 is a graph, showing a relationship between the amount per unit area of the clear toner and the gloss, prepared by plotting thereon the data in Table 1. An ordinate represents the gloss value at the clear toner-fixed portion. Further, an abscissa represents the amount per unit area of the clear toner (in terms of the image data pixel value). As is understood from the figure, when the clear toner image is fixed under the above-described fixing condition, the gloss value is lowered with an increasing amount per unit area of the clear toner. In the area in which the gloss is to be lowered, the clear toner image is formed in the amount per unit area of 0.5 mg/cm$^2$. For that reason, when the clear toner image is formed in the area in which the gloss is to be increased in order to suppress the occurrence of the image defect, the resultant gloss value approaches the gloss value in the area in which the gloss is to be lowered.

In this way, when the conversion is performed so that the clear toner is placed on a portion where the amount of the clear toner to be placed is small, a gloss mark is less visible. That is, when the second fixation is performed without placing the clear toner on the portion, a resultant gloss difference is large, so that the gloss mark is more visible. However, when the conversion is performed so that the clear toner is placed on the portion, the clear toner is placed on the portion where the amount of the clear toner to be placed intrinsically is small, so that the gloss mark is less visible.

Therefore, with respect to the gloss difference ΔGs between the gloss at the portion where the clear toner image is formed in the amount per unit area of 0.5 mg/cm$^2$ so as to lower the gloss and the gloss in the area in which the gloss is to be increased, the gloss value is measured by changing the amount per unit area of the clear toner in the area in which the gloss is to be increased.

TABLE 2

| *1 P.V. (%) | 0 | 10 | 20 | 30 | 40 | 50 | 60 | 70 | 80 | 90 | 100 |
|---|---|---|---|---|---|---|---|---|---|---|---|
| Gs (%) | 45 | 42 | 28 | 20 | 16 | 14 | 13 | 12 | 11 | 11 | 10 |
| ΔGs (%) | 35 | 32 | 18 | 10 | 6 | 4 | 3 | 2 | 1 | 1 | 0 |

*1: "P.V." represents a pixel value.

Table 2 shows the gloss values Gs and the gloss difference value ΔGs between the gloss values and gloss values at the time of fixing the clear toner image with the image data value of 100% when the clear toner image is fixed in 10% increments of the image data value from 0% to 100%. Generally, when the gloss difference ΔGs is decreased, a difference between a position in which the gloss mark is placed and a position in which the gloss mark is not placed cannot be discriminated.

A questionnaire survey concerning the gloss difference value ΔGs which can be said that there is the gloss difference was conducted by getting 20 people together. The results are shown in Table 3.

TABLE 3

| ΔGs (%) | 10 | 9 | 8 | 7 | 6 | 5 |
|---|---|---|---|---|---|---|
| *1 N.O.P | 20 | 20 | 18 | 14 | 10 | 3 |
| *2 Judgment | A | A | B | C | C | C |

*1: "N.O.P" represents the number of people (persons) who answered that there was the gloss difference.
*2: Judgment was made according to the following criterion. "A" represents that all the 20 people were able to discriminate clear marking. "B" represents that 18 or more people were able to discriminate the clear marking. "C" represents that only 14 or more people were able to discriminate the clear marking.

As shown in Table 3, in the case where the gloss difference was 8% or more, 90% or more of the 20 people were able to discriminate the clear marking. However, in the case where the gloss difference was less than 8%, only 70% or less of the 20 people were able to discriminate the clear marking.

Therefore, in the second area which is different from the first area in which the clear toner image for the partial adjustment of the image gloss is to be formed, the clear toner image is formed in order to suppress the image defect. At this time, in the case where the gloss difference between in the first area and in the second area is at least 8%, the gloss difference can be discriminated. For that reason, it is preferable that the clear toner is laminated in a predetermined amount so as to provide the gloss difference of 8% or more.

As is understood from Table 2, the image defect can be suppressed (Table 1) and the gloss difference value ΔGs between the (second) area and the gloss-increasing (first) area is 18% if the clear toner amount per unit area is 20% or more, so that the clear marking can be clearly discriminated.

From the above-described experimental results, it was found that the clear toner image may be formed in the area in which the clear toner image was not formed conventionally. For that reason, in this embodiment, the clear image data value at the pixel having the clear image data value of less than 20% to be inputted is converted into 20%.

[Flow Chart For Clear Mode]

Figure 7:
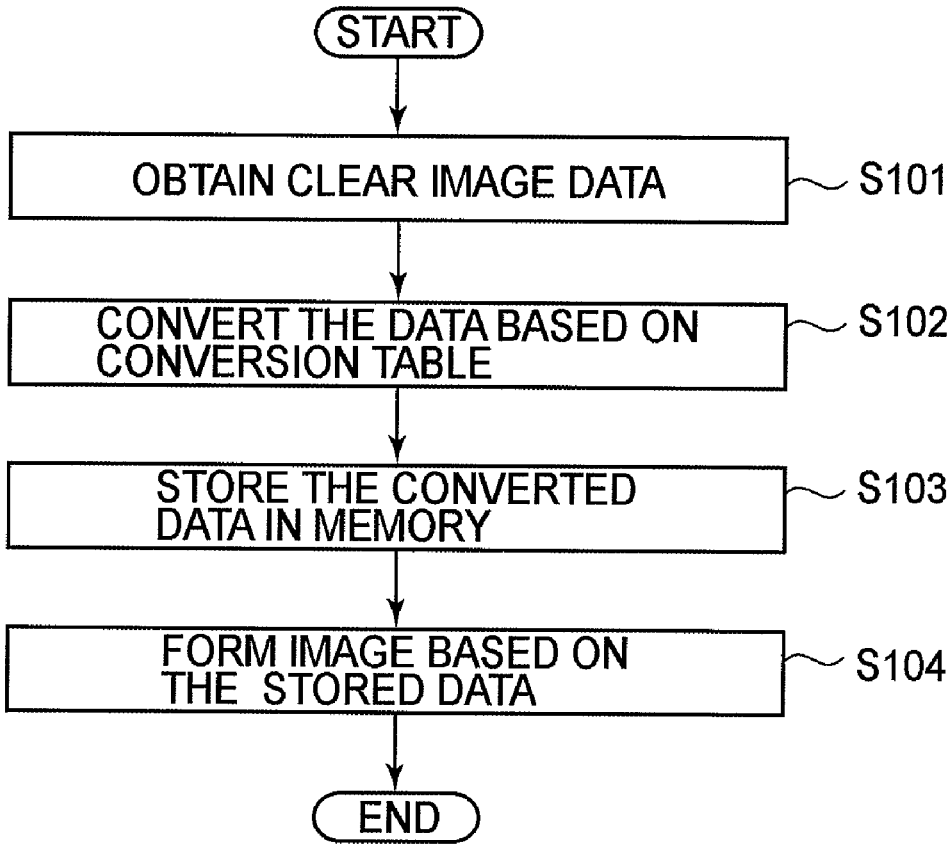
FIG. 7 is a flow chart showing a control process of the image forming system according to the present invention.

FIG. 7 is a flow chart for illustrating an operation of the image forming system when the clear mode is selected in this embodiment.

A step S101 is a step for obtaining the clear image data. The clear image data is sent from, e.g., a personal computer, a scanner, or the like. The controller K obtains the clear image data sent from the personal computer, the scanner, or the like. At this time, the controller K functions as the area obtaining means for obtaining the area in which the transparent toner image is to be formed and the obtaining means for obtaining the amount per unit area of the transparent toner.

A step S102 is a step for converting the clear image data obtained in the step S101 by using a clear image data conversion table. The controller K converts a value, of all the pixel values as the clear image data obtained by the controller K, of less than a threshold value (20% in this embodiment) into the threshold value (20% in this embodiment).

A step S103 is a step for storing the clear image data converted in the step S102 in the memory H. The controller K stores the converted clear image data in the memory H.

A step S104 is a step for executing the image formation on the basis of the image data stored in the memory H.

Figure 8:
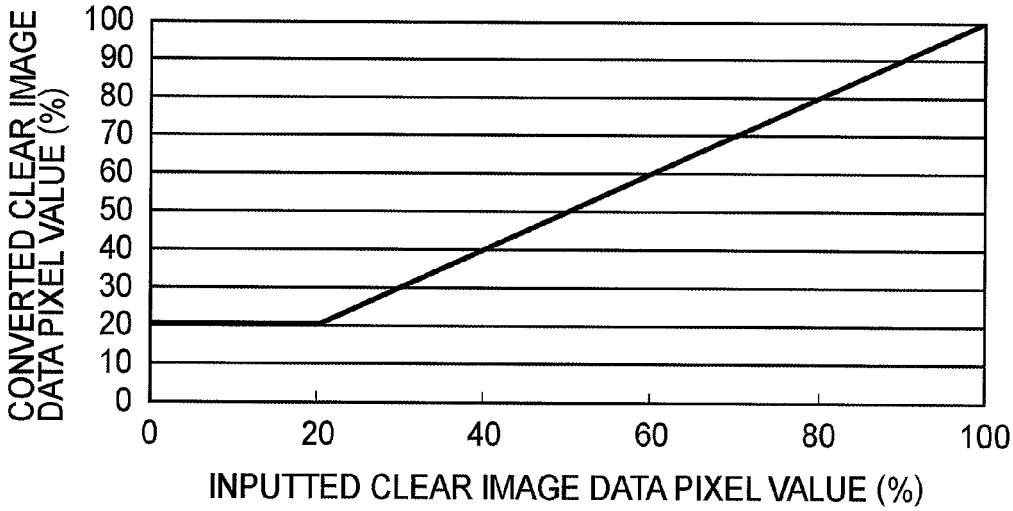
FIG. 8 is a graph showing an example of a clear image conversion table in the embodiment of the present invention.
Figure 9:
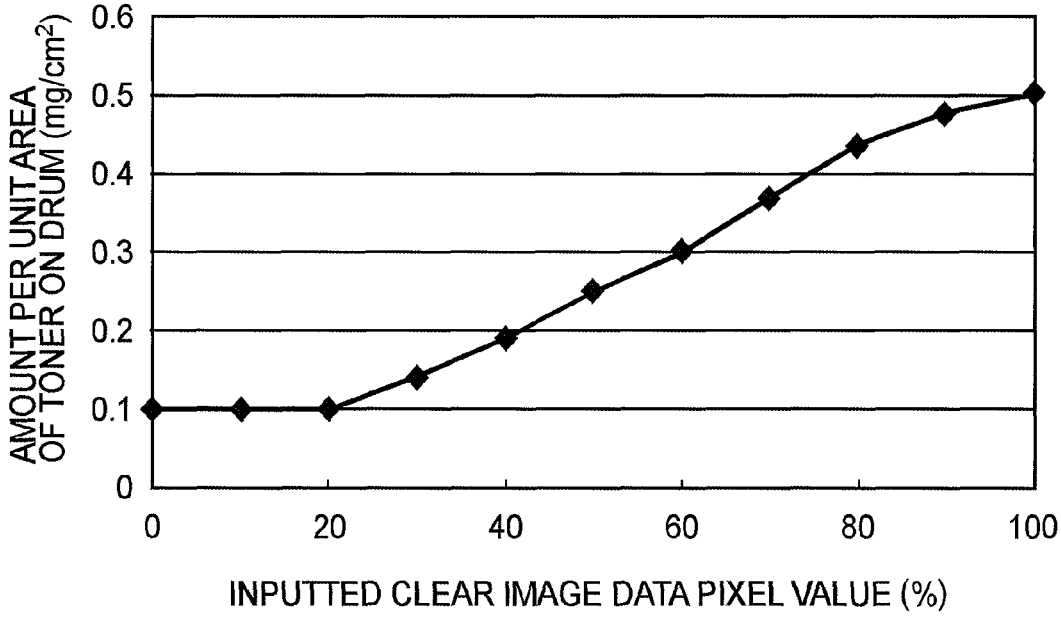
FIG. 9 is a graph showing a relationship between a pixel value of clear image data and an amount per unit area of toner on a drum in the embodiment of the present invention.

FIG. 8 is the clear image data conversion table showing a relationship between an inputted image signal (a clear image data value) and an outputted image density (a clear image data value after the conversion) with respect to an image density for the inputted image signal. Further, FIG. 9 is a graph showing a relationship between the amount per unit area of the toner formed on the photosensitive drum and the clear image data, as a result of the clear image data conversion as described above.

Accordingly, in a range in which the clear toner image data pixel value is 0% or more and less than 20%, the pixel value of the clear image data is converted so as to provide 20%. By using the thus-converted data, the transparent toner is placed in an area, in which the transparent toner image is formed irrespective of the area is an area in which the color toner images are formed in the above-described embodiment but at least the color toner images are formed, of a toner image formable area except for the area (the image area) obtained by the controller K as the area obtaining means in which the transparent toner image is to be formed. The controller K controls the image forming station Pe as the transparent toner image forming means so that the amount per unit area of the transparent toner to be placed is less than that in the above image area.

In this manner, when the clear toner image data pixel value is less than the setting value including zero, by placing the clear toner so that the outputted image density is the setting density provided in the conversion table, it is possible to prevent the occurrence of the image defect. Incidentally, in the case where the amount of the transparent toner image formed in the area (the image area) in which the transparent toner image designated by the inputted image data is to be formed is less than 20%, the image data value in the area is converted into 20%. For that reason, with respect to a finally outputted print, the transparent toner image of 20% or more is formed in the image area designated so as to place the transparent toner. Further, also with respect to the area except for the area designated so as to place the transparent toner (i.e., the area in which the image data value is 0%), the image data value is converted into 20%. For that reason, in the finally outputted print, the transparent toner image of 20% is formed in the area except for the image area (i.e., the area in which the image data value is 0%). For that reason, when the amount per unit area of the transparent toner image formed in the image area and that in the image formable area except for the image area are compared, the amount per unit area of the transparent toner image formed in the image formable area except for the image area can be made smaller than that in the image area.

On the other hand, at the pixels where the clear image data value is 20% or more, as shown in FIG. 8, the outputted image density is increased with an increasing image density level for the inputted image data. As a result, the glossiness is changed in a tone gradation manner. Further, a portion where the inputted image data value is less than 20% will be described in detail. The controller K as the control means changes the image data value at the portion where the inputted image data value is less than 20% (i.e., in the area in which the transparent toner image, of the transparent toner image to be formed in the image area, is to be placed in an amount per unit area less than the predetermined amount per unit area) to 20%. Then, the controller K controls the image forming station Pe as the transparent toner image forming means so that the transparent toner can be selectively placed in the amount per unit area equal to or more than the predetermined amount per unit area at the portion where the inputted image data value is less than 20%. Here, the image formable area refers to an area in which each of the image forming stations is capable of forming the toner image on the sheet.

[Two-Valued Clear Image Data]

In this embodiment, as described above, the clear toner image density level is changed so as to provide the predetermined setting data when it is less than the setting value but the clear toner is placed depending on the image density level given by the inputted image signal when the clear toner image density level is the setting value or more. However, when the image density level given by the inputted image signal is the setting value or more, irrespective of the image density level given by the inputted image signal, the outputted image density may also be set so as to be a predetermined data higher than the above-described setting density (i.e., be higher in the clear toner amount per unit area).

That is, the clear image data is converted into two-valued data. The clear marking cannot be changed in fine color tone as provided in the color images. For this reason, the case where the image is represented by two-valued data including a portion where the clear image is present and a portion where the clear image is absent can also be employed.

In this case, the image data sent from the personal computer or the like is the two-valued data of 0 and 1. By converting the two-valued data into data of 0 to 255 (0% to 100%), it is possible to output the image similarly through the above-described image forming method.

The image conversion table for this purpose may employ the following data as shown in Table 4.

TABLE 4

| Inputted pixel value (two-valued data) | Converted pixel value (%) |
|---|---|
| 0 | 20 |
| 1 | 100 |

Referring to Table 4, when the image data is 0, the clear toner is placed, in a small amount (the clear toner image density value of 20%) to such a degree that the image defect does not occur, in the area in which the gloss is to be increased. On the other hand, when the image data is 1, the clear toner is placed in an amount set for matting (the clear toner image density value of 100%). Also by performing the image gloss partial adjustment by the two-valued data as described above, the occurrence of the image defect can be presented. Further, by performing the processing with the two-valued data, the conversion table can be simplified. As a result, the controller K as the area obtaining means obtains the area in which the inputted two-valued data is 0 (i.e., the area except for the image area). The controller K changes the amount per unit area of the transparent toner placed in the area, in which at least the color toner images are formed (in this embodiment, the transparent toner image is also formed in the area other than the area in which the color toner images are fixed), of the area in which the two-valued data is 0. That is, the controller K converts the inputted two-valued data value of 0 into the image data value of 20% represented by percentage an converts the inputted two-valued data value of 1 into the image data value of 100% represented by percentage. Thus, the controller K controls the image forming station Pe as the transparent toner image forming means so that the amount per unit area of the transparent toner (20%) to be placed in the area in which the two-valued image data value is 0 (i.e., in the image formable area except for the image area) is less than that of the transparent toner (100%) to be placed in the area in which the two-valued image data is 1 (i.e., in the image area).

As described above, in the image forming system in which the toner images are formed and fixed by using the color toners and the clear toner, a good image can be obtained without causing the image defect at the color toner portion one subjected to the fixation.

Embodiment 2

An operation of an image forming system in this embodiment will be described with reference to FIG. 10. Incidentally, a fundamental structure of the image forming system in this embodiment is identical to that in Embodiment 1, thus being omitted from redundant explanation by being represented by the same reference numerals (symbols). A characteristic constitution in this embodiment will be described below.

In this embodiment, the image forming system changes the clear image data conversion table on the basis of image information on the color toner images.

This is because the image defect occurs by subjecting the color toner portion to fixation two times as described in Embodiment 1. That is, conversely, there is no occurrence of the image defect if there is no color toner portion.

Therefore, in this embodiment, on the basis of the color image data, at a pixel where there is no color image, the image data is outputted as it is similarly as in the conventional manner without using the clear image data conversion table. On the other hand, at a pixel where the color image is present, the image data is converted by using the clear image data conversion table similarly as in Embodiment 1.

That is, at the pixel where there is no color image, the clear toner is placed only in the area for matting and is not placed in the area for increasing the gloss similarly as in the conventional manner. In other words, even when the gloss is increased in such a manner, the image defect does not occur at the portion where there is no color image. By employing such a constitution, unnecessary placing of the clear toner on the pixel where the image defect does not occur. For that reason, it is possible to suppress an amount of consumption of the clear toner.

[Flow Chart for Clear Mode]

Figure 10:
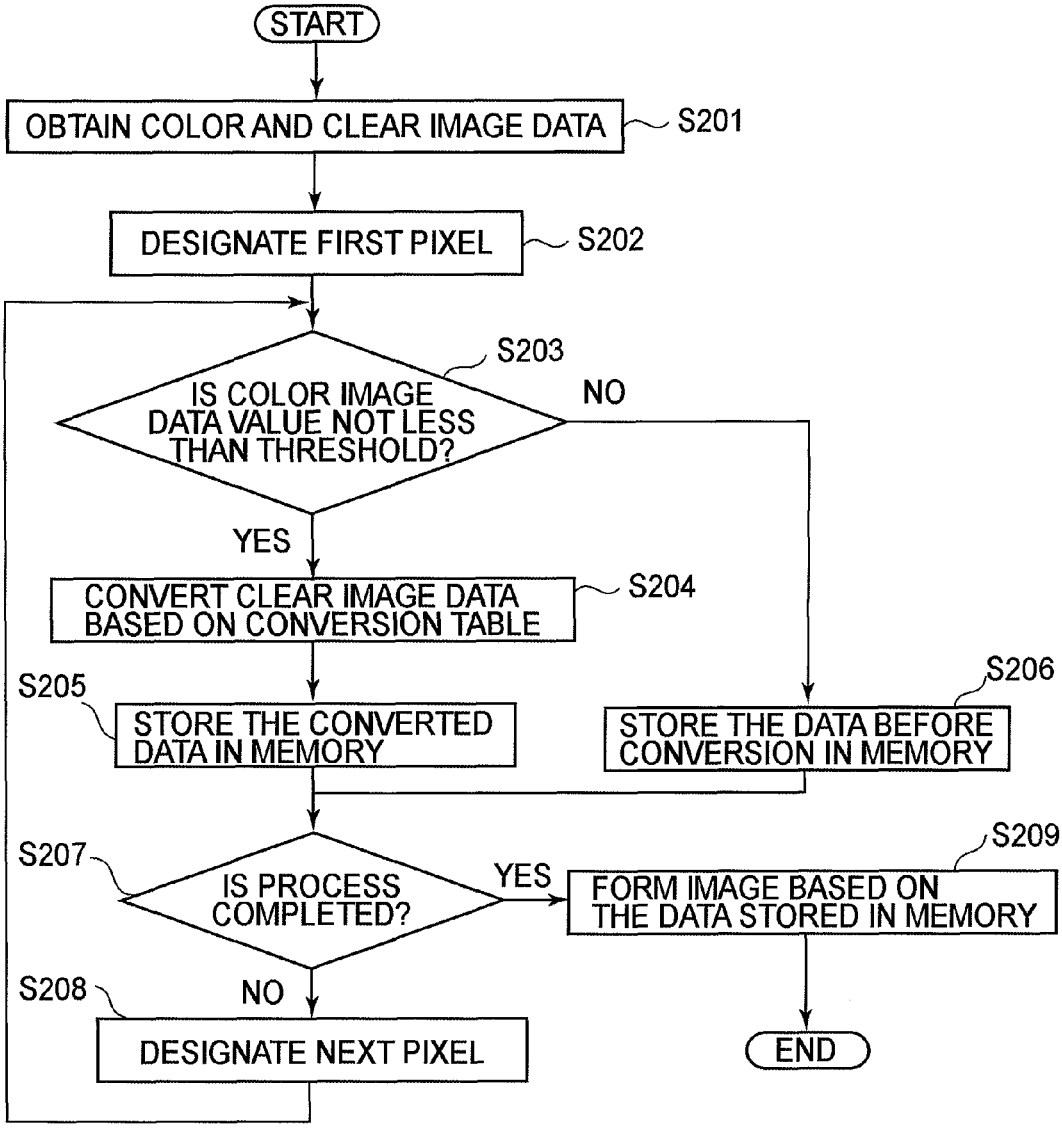
FIG. 10 is a flow chart showing a control process of an image forming system according to another embodiment of the present invention.

FIG. 10 is a flow chart for illustrating the operation of the image forming system when the clear mode is selected in this embodiment. The operation of the image forming system will be described in accordance with the flow chart shown in FIG. 10.

In a step S201, the color image data and the clear image data are obtained. The controller K obtains the color image data and the clear image data sent from the personal computer or the like.

In a step S202, in order to judge whether or not the color image is present for each pixel, a first pixel of pixels for all the image data values of the color images to be formed on the sheet is designated.

In a step S203, a color image data value at the designated pixel is judged as to whether or not it is a threshold value or more (1 or more in this embodiment). The controller K executes a step S204 when the color image data pixel value at the designated pixel is 1 or more (i.e., in the case where the controller image is present). Further, the controller K executes a step S206 when the color image data pixel value at the designated pixel is 0 (i.e., in the case where the color toner images are not formed on the sheet).

In the step S204, the pixel value of the clear image data corresponding to the designated pixel is converted. Similarly as in Embodiment 1, the clear image data pixel value corresponding to the designated pixel is converted by using the clear image data conversion table (FIG. 8). That is, in the case where the clear image data pixel value corresponding to the designated pixel is less than the threshold value (20% in this embodiment), the pixel value was converted into 20%.

In a step S205, the transparent image data converted in the step S204 is stored in the memory H. The controller K stores the clear image data value converted in the step S204 in the memory H.

The step S206 is executed when the pixel value of the color image data at the designated pixel is 0 in the step S203. As described above, in the case where the color image data at the designated pixel is 0, the image defect does not occur, so that the pixel value of a corresponding clear image data is not converted.

In a step S207, with respect to all the pixels corresponding to data of the images to be formed on the sheet, judgment as to whether or not the above-described processing is executed is made. In the case where the above-described processing is completely executed with respect to all the pixels, processing in a step S209 is executed.

In a step S208, in order to execute the above-described processing at all the pixels, a pixel subsequent to the designated pixel is designated.

The step S209 is executed when the above-described processing is performed at all the pixels. In this case, the controller K controls the image forming system so that the clear image is formed on the sheet on the basis of the clear image data stored in the memory H.

Through the above-described steps, in the color image area, the occurrence of the image defect in the area for increasing the gloss is prevented.

By employing the above-described constitution, the image defect can be remedied and it is also possible to suppress unnecessary consumption of the clear toner.

As described above, in the image forming system in which the images are formed and fixed by using the color toners and the clear toner, a good image can be obtained without causing the image defect at the color toner portion once subjected to the fixation.

Embodiment 3

An operation of an image forming system in this embodiment will be described with reference to FIG. 11. Incidentally, a fundamental structure of the image forming system in this embodiment is identical to that in Embodiment 1, thus being omitted from redundant explanation by being represented by the same reference numerals (symbols). A characteristic constitution in this embodiment will be described below.

In this embodiment, the clear image data conversion is executed depending on the color image data pixel value and the type of the sheet on which the image is to be formed.

In this embodiment, the pixel where the color toner image data was present was studied. As a result, with respect to the above-described image defect, it was found that the color image data pixel value at which the image defect started to occur was different depending on the color toner amount per unit area and the type of paper.

For example, in the case where the image was formed on A0 gloss coated paper, when the second fixation was performed without forming the clear toner image at the color image data pixel value exceeding 150%, it was found that the image defect occurred at the portion which was not covered with the clear toner. That is, with respect to the A0 gloss coated paper, in the case where the color image data pixel value was 150% or less, it was found that the image defect did not occur at the portion which was not covered with the clear toner.

Therefore, the color image data pixel value at which the image defect started to occur was studied also similarly on other types of sheets. Table 5 provides a summary of the color image data pixel value at which the image defect started to occur in a state in which the clear toner was not placed in the area for increasing the gloss.

TABLE 5

| Type of paper | *1 Pixel value (%) |
|---|---|
| Quality paper | 100 |
| A0 gloss coated paper | 150 |
| A1 gloss coated paper | 130 |
| A1 matt coated paper | 110 |

*1 "Pixel value" represents a color image data pixel value (%) at which the image defect started to occur.

As is understood from Table 5, even in the case where the small amount of the clear toner is not formed, when the color image data pixel value is small (when the toner amount of the image formed on the sheet is small), the image defect does not occur even by subjecting the color toner portion to the fixation two times. This can be considered that the image defect does not occur because the toner is present in fibers of paper as the recording material in the area in which the color image data pixel value is small (the area in which the amount of the toner placed on the sheet is small), so that the toner can escape from a gap between the roller and the fibers. On the other hand, when the color image data pixel value is increased (when the amount of the toner placed on the sheet is large), the toner fills a gap among the fibers of paper, so that the toner surface becomes smooth by the first fixation. For this reason, it can be considered that the air present at the gap between the roller and the toner layer cannot escape from the gap during the second fixation.

As described above, although a degree of occurrence of the image defect varies depending on the type of the image forming sheet, it has been found that the image defect does not occur even when the small amount of the clear toner image is not formed in the case where the amount of the color toner images formed on the sheet is small. For that reason, when the color toner is used in an amount not causing the image defect even when the color toner is subjected to the fixation two times, the clear toner image is not formed. By employing such a constitution, unnecessary placing of the clear toner on the pixel where the image defect does not occur. For that reason, it is possible to suppress an amount of consumption of the clear toner.

[Flow Chart for Clear Mode]

Figure 11:
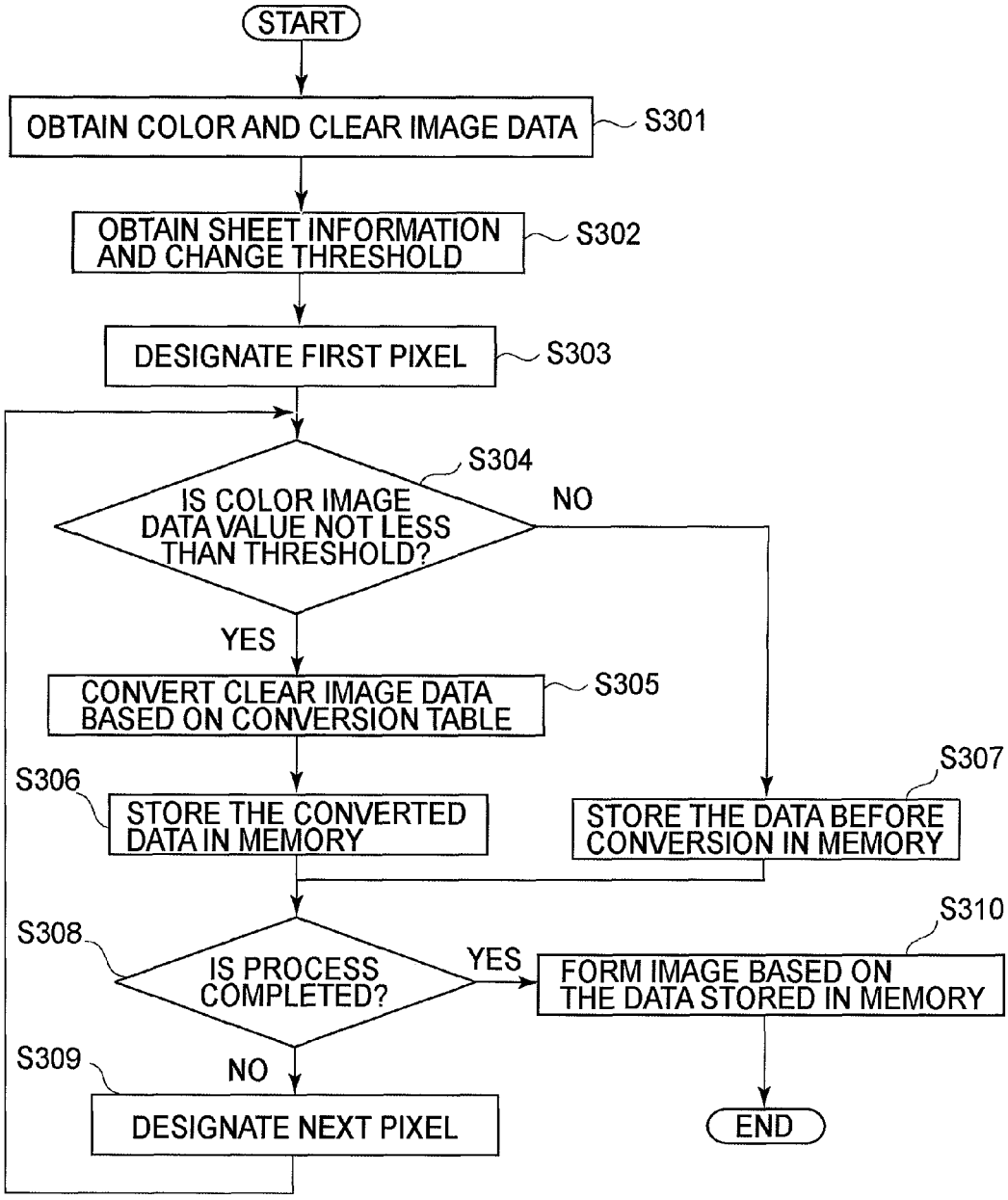
FIG. 11 is a flow chart showing a control process of an image forming system according to still another embodiment of the present invention.

FIG. 11 is a flow chart for illustrating the operation of the image forming system when the clear mode is selected in this embodiment. The operation of the image forming system will be described in accordance with the flow chart shown in FIG. 11.

In the following embodiment, the image forming sheet is the A0 gloss coated paper. At that time, the image defect occurrence start pixel value of the color image data is 150%.

In a step S301, the color image data and the clear image data are obtained. The controller K obtains the color image data and the clear image data sent from the personal computer or the like.

In a step S302, information on the image forming sheet is obtained and a threshold value to be used in a step S304 is changed depending on the sheet used. The controller K obtains the information on the image forming sheet (the A0 gloss coated paper in this embodiment) and sets the threshold value (150% in this embodiment) to be used in the step S304.

In a step S303, in order to judge whether or not the color image is present for each pixel, a first pixel of pixels for all the image data values of the color images to be formed on the sheet is designated.

In the step S304, a color image data value at the designated pixel is judged as to whether or not it is a threshold value or more (150% or more in this embodiment). The controller K executes a step S305 when the color image data pixel value at the designated pixel is 150% or more. Further, the controller K executes a step S307 when the color image data pixel value at the designated pixel is less than 150%.

In the step S305, the pixel value of the clear image data corresponding to the designated pixel is converted. Similarly as in Embodiment 1, the clear image data pixel value corresponding to the designated pixel is converted by using the clear image data conversion table (FIG. 8). That is, in the case where the clear image data pixel value corresponding to the designated pixel is less than the threshold value (20% in this embodiment), the pixel value was converted into 20%.

In a step S306, the transparent image data converted in the step S305 is stored in the memory H. The controller K stores the clear image data value converted in the step S305 in the memory H.

The step S307 is executed when the pixel value of the color image data at the designated pixel is less than 150% in the step S203. As described above, in the case where the color image data at the designated pixel is less than 150%, the image defect does not occur, so that the pixel value of a corresponding clear image data is not converted.

In a step S308, with respect to all the pixels corresponding to data of the images to be formed on the sheet, judgment as to whether or not the above-described processing is executed is made. In the case where the above-described processing is completely executed with respect to all the pixels, processing in a step S310 is executed.

In a step S309, in order to execute the above-described processing at all the pixels, a pixel subsequent to the designated pixel is designated.

The step S310 is executed when the above-described processing is performed at all the pixels. In this case, the controller K controls the image forming system so that the clear image is formed on the sheet on the basis of the clear image data stored in the memory H.

Through the above-described steps, in the color image area, the occurrence of the image defect in the area for increasing the gloss is prevented.

Incidentally, the threshold value used for the judgment in the step S304 is changed depending on the type of the sheet obtained in the step S302 but may also be settable by a user.

By employing the above-described constitution, the image defect can be remedied and it is also possible to further suppress unnecessary consumption of the clear toner.

As described above, in the image forming system in which the images are formed and fixed by using the color toners and the clear toner, a good image can be obtained without causing the image defect at the color toner portion once subjected to the fixation.

Embodiment 4

In this embodiment, a color image forming system and a clear image forming system are separate apparatuses. Further, as the clear toner, toner having a Tg (glass transition point) lower than that of (i.e., easily meltable than) the color toner was used. For that reason, different from Embodiments 1 to 3, there is a tendency such that the gloss at the portion where the clear toner image is formed is higher than that at the portion where the clear toner image is not formed.

The apparatuses used in this embodiment will be described with reference to FIG. 12 to FIG. 15. The fundamental structures of the apparatuses in this embodiment are identical to that in Embodiment 1 described above, thus being omitted from redundant explanation. A characteristic constitution in this embodiment will be described. Further, members or means having the same functions as those in Embodiments 1 to 3 are represented by the same reference numerals or symbols.

Figure 12:
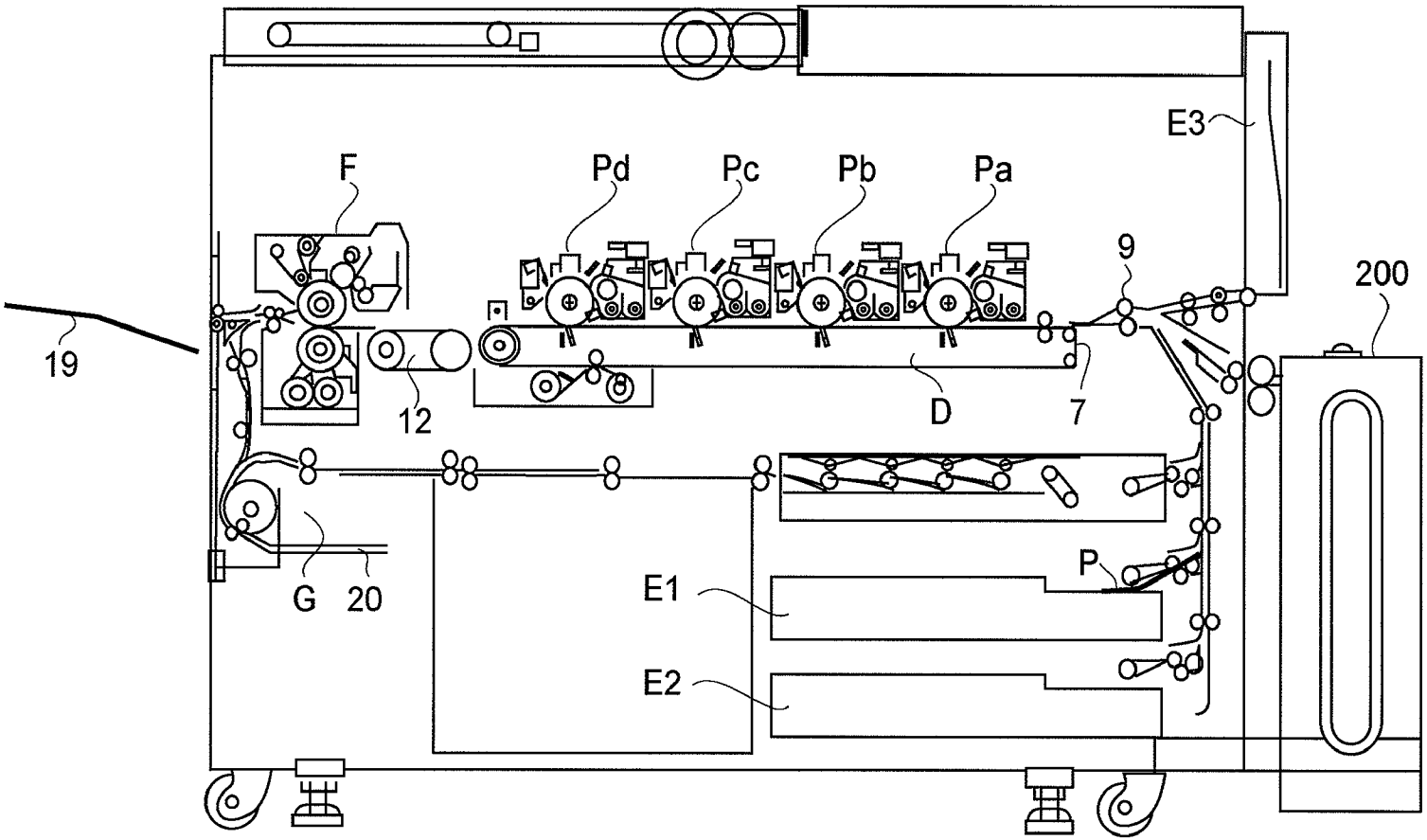
FIG. 12 is a schematic view showing a structure of a color image forming system according to a further embodiment of the present invention.

In this embodiment, a full-color image forming system as shown in FIG. 12 is used for first image formation and fixation in which the color toner images are formed. Further, for second image formation and fixation using the clear toner, an image forming system, as shown in FIG. 13, which effects only clear image formation is used.

The full-color image forming system of FIG. 12 has a constitution in which the clear image forming station is eliminated from the image forming system described in Embodiment 1 and performs the same operation as that in the non-clear mode described in Embodiment 1. Incidentally, the color toners have the glass transition point (Tg) of 55° C.

Figure 13:
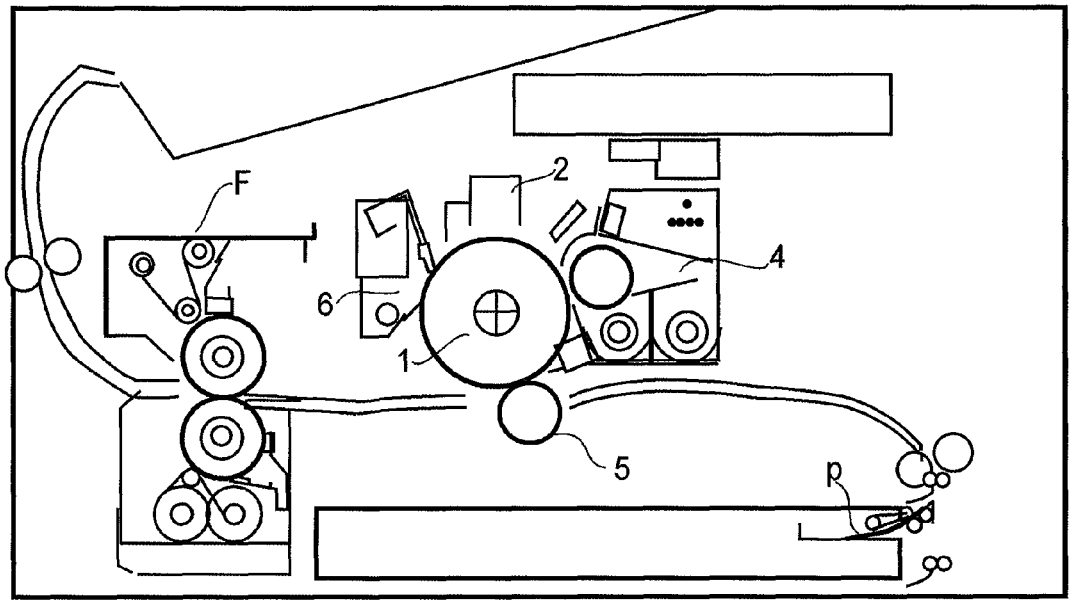
FIG. 13 is a schematic view showing a structure of a clear image forming system according to the further embodiment of the present invention.

In the image forming system of FIG. 13, the clear toner manufactured through a suspension polymerization method is used. As a parting material, wax is contained in the clear toner, so that a fixing device F has a constitution in which the means for applying the oil to the fixing roller is eliminated from the fixing device, shown in FIG. 3, used in Embodiment 1. Incidentally, the process speed of the image forming system of FIG. 13 is 100 mm/sec. The control temperature (target temperature) of the fixing roller 51 and the pressing roller 52 are both 160° C. As the sheet, A2 gloss coated paper having a basis weight of 150 g/m$^2$ is used. The clear toner has the glass transition point (Tg) of 45° C.

As a result, on the image after the image formation is performed with the clear toner, the gloss for the clear toner is higher than that for the color toners. For this reason, in this embodiment, during the second image form with the clear toner, the clear toner is placed on the portion where the gloss is increased to provide luster.

Figure 14:
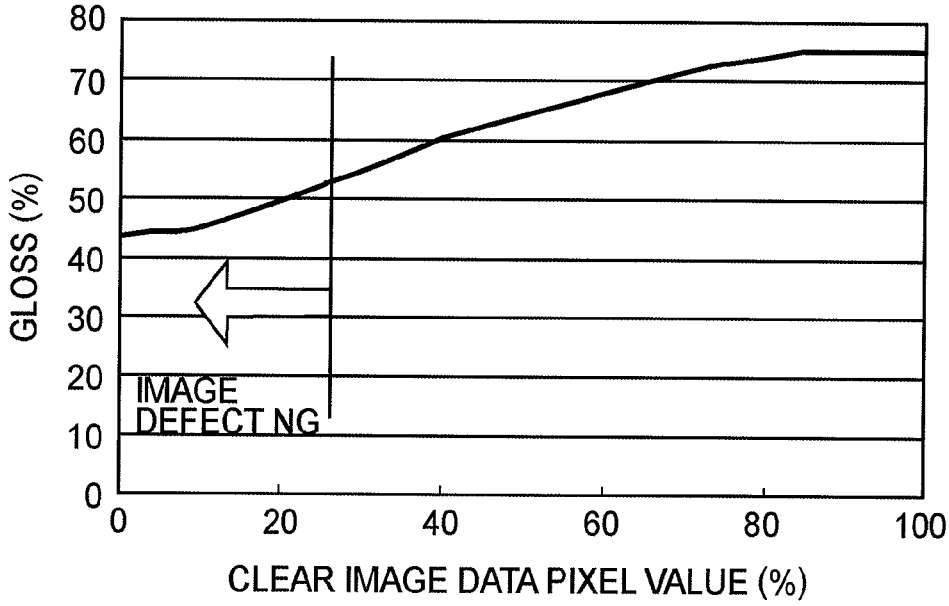
FIG. 14 is a graph showing a relationship between a pixel value of clear image data and gloss in the further embodiment of the present invention.

FIG. 14 is a graph showing a relationship between a clear image data pixel value and a gloss value when the color toner images having the pixel value of 200% are fixed during the first fixation and thereon the clear toner image is formed and fixed. In FIG. 14, an occurrence range of the image defect ("NG") is also indicated.

In this constitution, when the clear image data pixel value was 25% or more, the image defect did not occur. That is, when the clear image data pixel value is less than 25%, the image defect occurs. For that reason, similarly as in Embodiment 1, in the case where the inputted value of the clear image data is less than 25%, the value is converted into 25% by using the clear image data conversion table. Incidentally, when the image data value of the clear toner is 25%, the amount per unit area of the clear toner fixed on the sheet is 0.15 mg/cm$^2$.

The gloss value when the clear image data value is 25% is 50%. Further, the gloss value when the clear image data value is 100% is 70%. For that reason, the image defect does not occur by converting the data corresponding to the pixel having the clear image data value of less than 25% into 25%. Further, as described in Embodiment 1, the gloss difference can be visually recognized.

[Flow Chart for Clear Mode]

In this embodiment, similarly as in Embodiment 1, the inputted clear image data is converted in accordance with the flow chart shown in FIG. 7. In this embodiment, in the step S102, as the clear image data conversion table, a clear image data conversion table shown in FIG. 15 is used.

Figure 15:
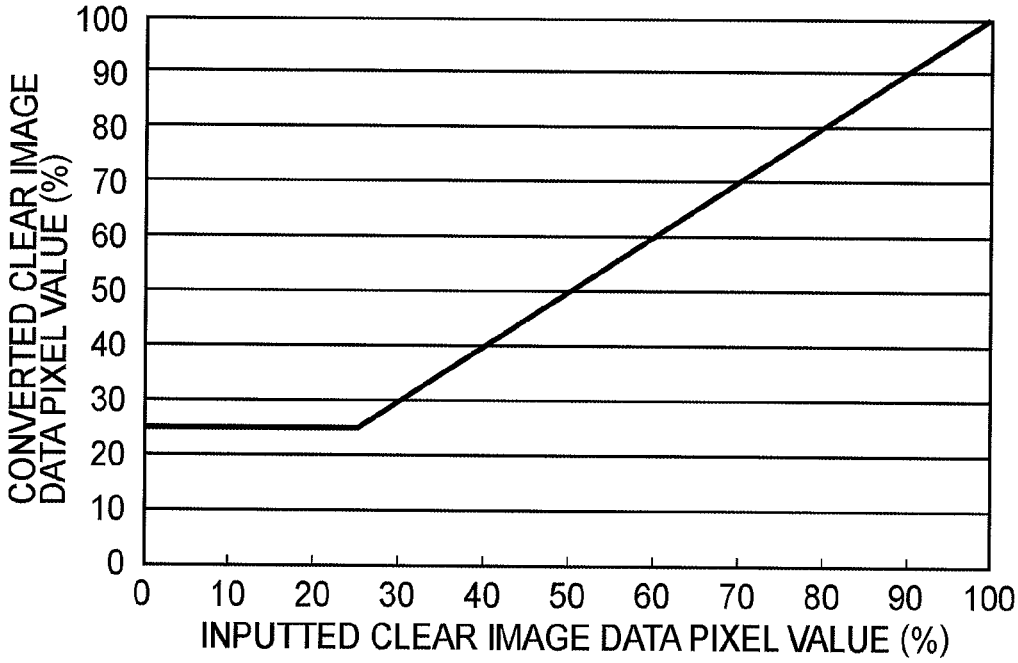
FIG. 15 is a graph showing an example of a clear image conversion table in the further embodiment of the present invention.

As shown in FIG. 15, in this embodiment, the clear image data value of 25% is provided and when the clear image data value is a setting value or less, the value is converted into 25%. That is, the clear toner is not placed intrinsically on the sheet in the area, in which the gloss is not increased, of the image area of the sheet. However, in such a state, when the second fixation is performed, there is a possibility of the occurrence of the image defect. For that reason, the occurrence of the image defect is suppressed by placing a small amount of the clear toner (corresponding to the clear image data pixel value of 25%) on the sheet in such an area. Thus, in this embodiment, when the image formation was performed by using the clear image data conversion table shown in FIG. 15, a good image free from the image defect was obtained. As is understood from comparison of this embodiment with Embodiments 1 to 3, a condition under which the image defect occurs varies when the image forming condition is changed.

As described above, in the image forming system in which the images are formed with the color toners and the clear toner, the good image can be obtained without causing the image defect at the color toner portion once fixed.

Embodiment 5

In Embodiment 1 to Embodiment 4, the clear image data conversion was performed in the image forming system. However, the clear image data conversion is not necessarily performed in the main assembly of the image forming system. In this embodiment, the personal computer (PC) as external equipment connected with the image forming system executes the clear image data conversion. In the PC, a program for executing the clear image data conversion is installed in an HDD (hard disk drive). The PC executes various processes in accordance with the installed program. As a result, similarly as in Embodiment 1 to 4, it is possible to suppress the occurrence of the image defect. A schematic structure of the PC will be described below.

(Hardware Structure of Pc)

A PC 1000 is connected with an image forming system 100 to constitute an image forming system. In this embodiment, the PC and the image forming system are communicatably connected with each other through an ethernet I/F (interface).

The PC is an external terminal capable of sending print job (instruction) to the image forming system. For that purpose, it is also possible to use other terminals capable of sending the print job to an MFP (multifunction peripheral) as an alternative to the PC. For example, it is possible to use portable information terminals such as a WS (work station) and a PDA (personal digital assistant).

Figure 16:
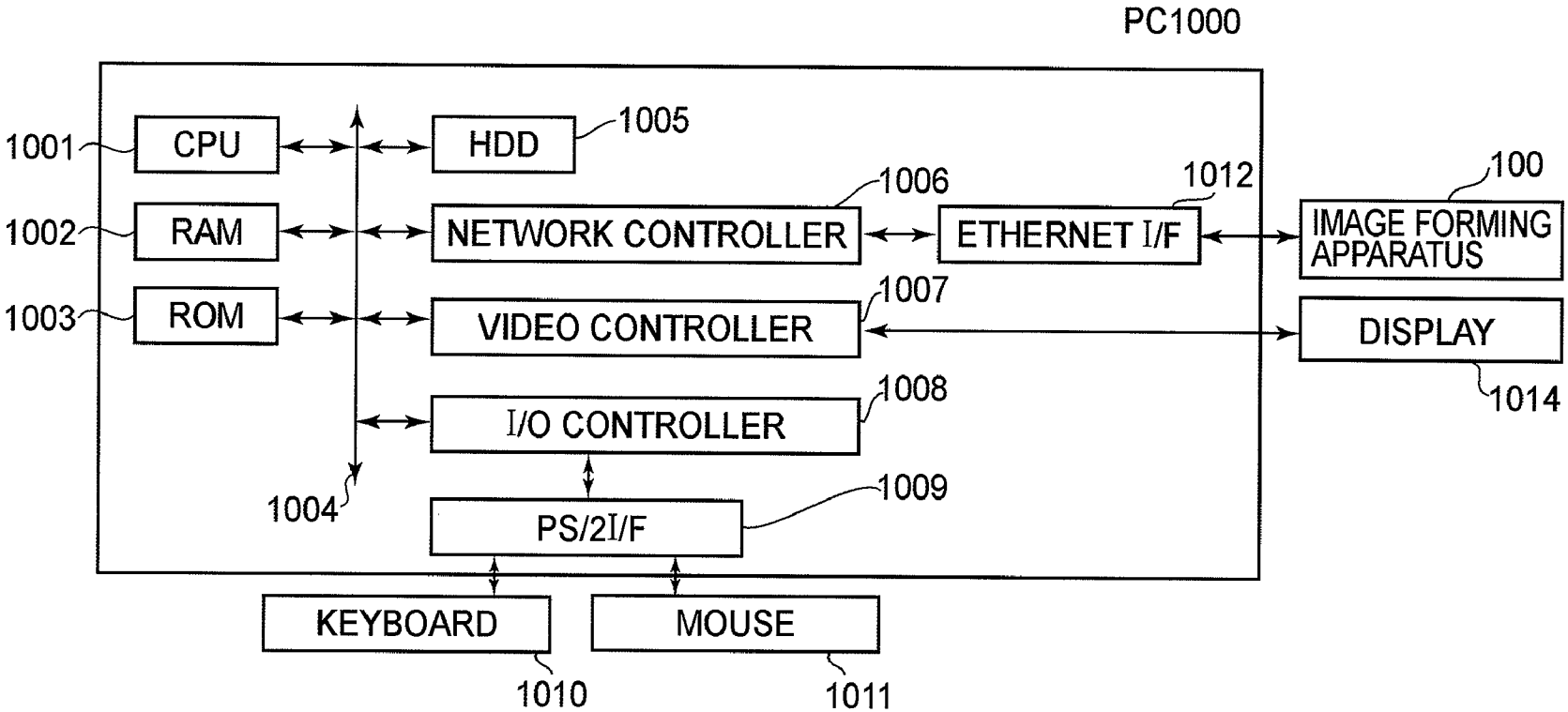
FIG. 16 is a block diagram showing a schematic structure of a personal computer (PC) as an external device in a still further embodiment of the present invention.

FIG. 16 is a block diagram showing the hardware structure of the PC 1000 as an example of the PC. The hardware structure of the PC 1000 will be described.

A CPU (central processing unit) 1001, an RAM (random access memory) 1002, and an ROM (read only memory) 1003 are connected to a bus 1004. Similarly, a HDD 1005, a network controller 1006, a video controller 1007, and an I/O (input/output) controller 1008 are connected to the bus 1004. The various units connected to the bus 1004 are communicatable with each other through the bus 1004. The CPU 1001 executes a program, e.g., stored in the ROM 1003 by expanding the program in the RAM 1002. Further, the CPU 1001 sends control instructions and the like to the HDD 1005, the network controller 1006, the video controller 1007, and the I/O controller 1008 through the bus 1004. Further, the CPU 1001 receives signals for indicating states and data such as image data from the HDD 1005, the network controller 1006, the video controller 1007, and the I/O controller 1008 through the bus 1004. Thus, the CPU 1001 is capable of controlling the various units constituting the PC 1000.

The PC 1000 is connected with the image forming system 100 through an ethernet I/F 1012. In the case where the PC 1000 communicates with the image forming system 100 through the ethernet I/F, a communication path is not limited to that in a LAN (local area network) but may also be that through the Internet. Further, to the PC 1000, a keyboard 1010 and a mouse 1011, as an input device, are connected through a PS2 I/F 1009. Further, to the PC 1000, a display 1014 as a displaying means is connected.

In this embodiment, the CPU 1001 controls various pieces of hardware constituting the PC in accordance with an OS (operating system) which is basic software installed in the HDD. As a result, the user can cause the PC to execute a desired operation by manipulating a GUI (graphical user interface) without concern for the hardware constituting the PC. Further, the user is capable of sending the print job from an application program, which has been installed in the HDD and is running under the OS, to the external image forming system. When the print job is sent to the image forming system, a control method varies depending on the kind of the image forming system. For that reason, the PC produces control instructions depending on the image forming system by using a driver program corresponding to the kind of the image forming system. The driver program installed in the HDD is capable of producing the control instructions depending on the connected peripheral equipment by being incorporated in a part of the OS. In this embodiment, the clear image data conversion is performed by the driver program installed in the HDD. The explanation on the example of the hardware structure of the PC is as described above.

[Screen Example Displayed on Display Connected to PC]

Figure 17:
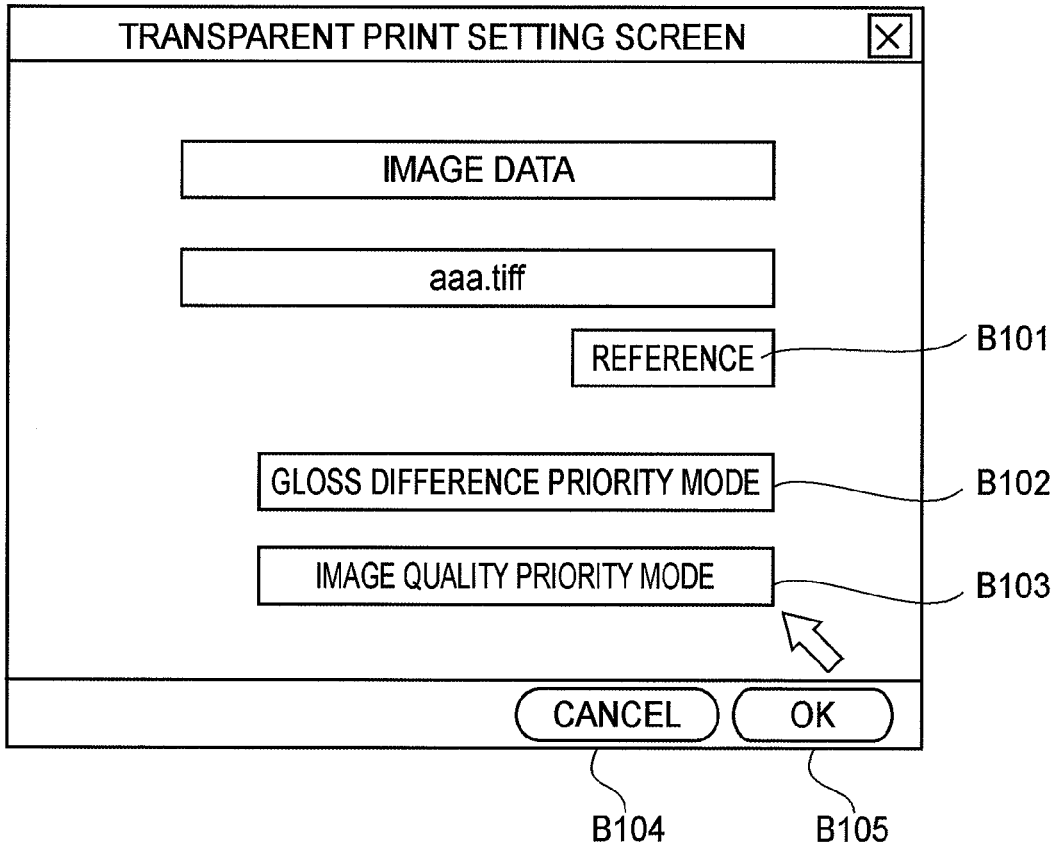
FIG. 17 shows an example of a screen image displayed at a display portion by the PC in the still further embodiment of the present invention.

An operation screen displayed on the display 1014 connected to the PC 1000 when the print job is sent from the PC to the image forming system will be described below. FIG. 17 is a schematic view showing an example of the screen displayed on the display 1014 by the PC 1000. The user can effect various settings with respect to items displayed on the display by using the input device such as the mouse. When a gloss mark is formed on the sheet, separately from the color image data sent to the image forming system, it is necessary to send image data required for forming the gloss mark.

On a setting screen shown in FIG. 17, the user can set image data required during formation of the gloss mark on the sheet by using the clear toner. Further, the user can set either one of a "gloss difference priority mode" in which the clear toner image is formed without converting the image data and an "image quality priority mode" in which the uneven glossiness is suppressed by converting the image data.

Buttons B101 to B105 displayed on the screen are selectable by using the mouse 1011 connected to the PC 1000. On the screen shown in FIG. 17, the user can set the clear image data used for forming the transparent toner image by the image forming system and can set the modes.

The user can set the clear image data by selecting the button B101. In the case where the button B101 is selected, the image data stored in the HDD can be set as the clear image data. The set clear image data is obtained by the CPU 1001 as an image data obtaining means. On the screen shown in FIG. 17, as the clear image data, "aaa.tiff" is set.

Next, the setting of the mode will be described. In this embodiment, two modes are selectably displayed on the display 1014. The button B102 is used for selecting the gloss difference priority mode as a first mode. The button B103 is used for selecting the image quality priority mode as a second mode. The CPU 1001 as a display control means send instructions, such that the screen as shown in FIG. 17 is displayed on the display 1014, to the video controller 1007. The user can select one of the modes selectably displayed on the display. The user presses an "OK" button B105 after setting the clear image data and the mode, so that the transparent toner image can be formed by the image forming system. As a result, the CPU 1001 as a mode obtaining means can obtain the mode selected by the user. Further, by pressing a cancel button B104, these settings are cleared.

[Flow Chart for PC Operation]

Figure 18:
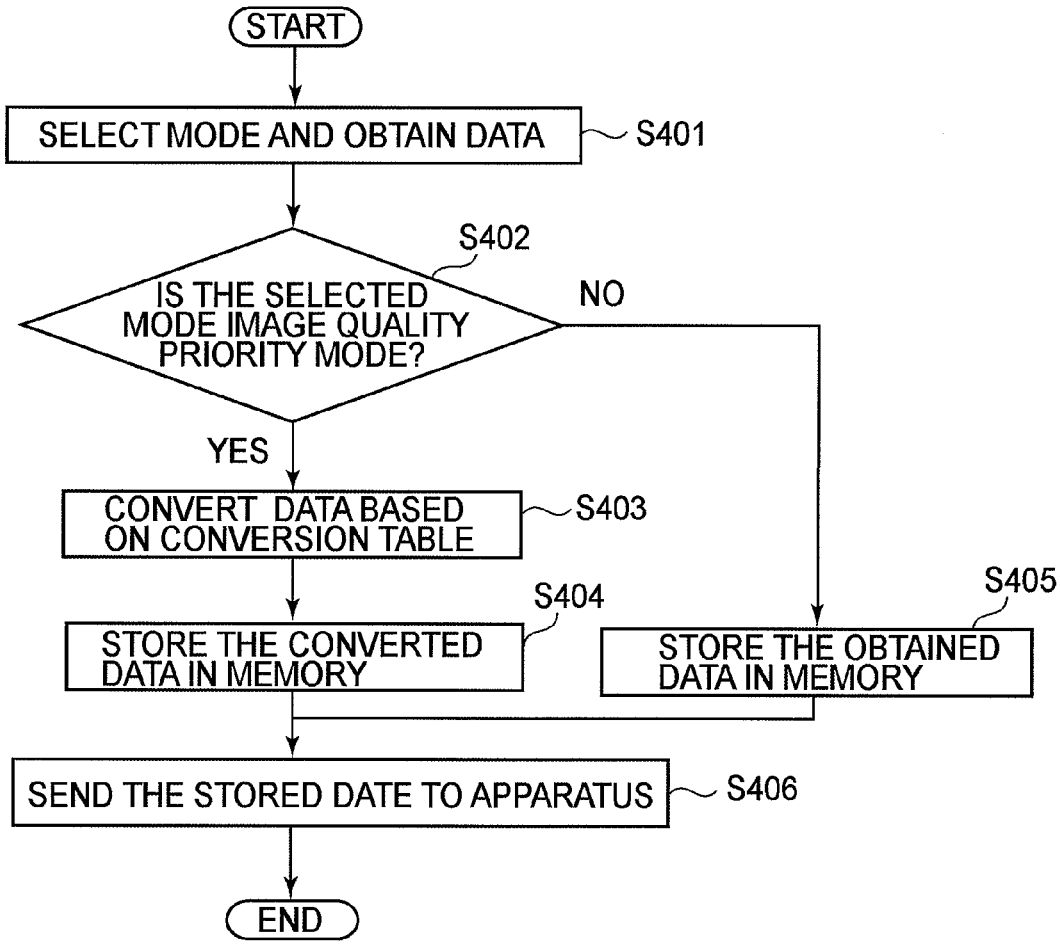
FIG. 18 is a flow chart shown by a program executed by the PC in the still further embodiment of the present invention.

A procedure for performing image processing by the PC 1000 in accordance with the driver program stored in the HDD 1005 will be described along a flow chart. The PC in the case where the clear image data and the mode are set and then the OK button B105 is pressed operates as follows. FIG. 18 is a flow chart for illustrating a program executed by the PC. Steps in the program will be described in detail below.

In a step S401, the screen shown in FIG. 17 is displayed on the display and the displayed clear image data and mode are obtained. The CPU 1001 controls the video controller 1007 so that the screen shown in FIG. 17 is displayed on the display 1014. In association with this, the user can set the mode and the clear image data by using the mouse 1011 or the keyboard 1010. The user presses the OK button B105, so that the CPU 1001 obtained the clear image data and the mode.

In a step S402, processing executed depending on the mode obtained in the step S401 is changed. The CPU 1001 executes processing of a step S403 when the mode selected in the step S401 is the "image quality priority mode". Further, the CPU 1001 executes processing of a step S405 when the mode selected in the step S401 is the "gloss difference priority mode".

In the step 403, the processing is executed in the case where the "image quality priority mode" is selected. The CPU 1001 converts data values, corresponding to the clear image data for all the pixels obtained in the step S401, on the basis of the clear image data conversion table (FIG. 8). The clear image data conversion table is stored in the ROM 1003.

In a step S404, the converted clear image data in the step S403 is stored in the RAM 1002. The CPU 1001 effects control so that the clear image data converted in the step S403 is stored in the RAM 1002.

In the step S405, the processing is executed when the "gloss difference priority mode" is selected in the step S401. The CPU 1001 effects control so that the clear image data obtained in the step S401 is stored in the RAM 1002.

In a step S406, the clear image data stored in the RAM 1002 in the step S404 or S405 is sent to the image forming system. The CPU 1001 sends the clear image data stored in the RAM 1002 to the image forming system 100 through the ethernet I/F 1012. The image forming system forms the transparent toner image on the sheet on the basis of the received clear image data so as to cover the sheet on which the color toner images have been fixed.

As described above, when the "image quality priority mode" is selected, the conversion is performed with respect to the clear image data. As a result, it is possible to achieve the same effect as in the case where the image processing is executed in the image forming system main assembly. Further, in this embodiment, it is possible to selectably execute the "gloss difference priority mode" and the "image quality priority mode". As a result, the image formation with the user's intention can be carried out.

The processing of the step S403 executed when the "image quality priority mode" is selected corresponds to the processing of the step S102 shown in FIG. 7. In this embodiment, the processing corresponding to that of the step S102 was performed in the PC. The processing executed when the "image quality priority mode" is selected may also be processing corresponding to the image processing for suppressing the uneven glossiness shown in FIG. 10 or FIG. 11.

Further, the program for executing such characteristic processing may also be supplied from a remote device to an information processing system or an information processing apparatus. Further, the information processing apparatus included in the information processing system may read and execute program mode stored in an external information processing apparatus.

That is, the program itself to be installed in the PC is used for realizing the above-described processing. The form of the program is not limited so long as the PC can execute the above-described processing by using the program.

As a recording medium for supplying the program, e.g., it is possible to use a flexible disk, a hard disk, an optical disk, a magneto-optical disk, a CD-ROM (compact-disk read-only memory), a CD-R (compact disk-recordable), a CD-RW (compact disk-rewritable), and the like. Further, as the recording medium, it is also possible to use a magnetic tape, a non-volatile memory card, an ROM, a DVD (digital versatile disk) (DVD-ROM or DVR-R (recordable)), and the like.

The program may also be downloaded from a homepage (web site) on the Internet by using a browser. That is, from the homepage, the program itself or a program file which is compressed and has an auto-install function is downloaded into the recording medium such as the hard disk. Further, it is also possible to obtain the program by dividing a program constituting the program for executing the above-described processing into a plurality of files and by downloading the divided files from different homepages, respectively. That is, there is a possibility that a WWW (world wide web) server capable of downloading a program file with respect to a plurality of users constitutes a constituent feature.

Further, the program file may also be distributed to the users by being encrypted and then being stored in a storage medium such as the CD-ROM. In this case, it is also possible to permit only a user who fulfils a predetermined requirement (condition) to download key information for decrypting the encrypted program, execute the decryption of the encrypted program with the key information, and install the program into the PC.

Incidentally, on the basis of instructions from the program, the OS running on the PC may also execute a part or all of actual processing.

Further, the program read from the recording medium may also be written (stored) in a memory provided to a function expanding board inserted into the PC or a function extending unit connected to the PC. On the basis of the instructions, a CPU provided in the function expanding board or the function extending unit may also execute a part or all of the actual processing.

Other Embodiments

In the above-described Embodiments, the fixing device using the rubber roller pair is described but the present invention is not necessarily limited to the fixing device. A similar effect can also be achieved even when a fixing device using a fixing belt or a belt fixing device using a pressing belt in place of the pressing roller is employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 110844/2008 filed Apr. 22, 2008 and 047859/2009 filed Mar. 2, 2009, which are hereby incorporated by reference.

What is claimed is:

1. A control apparatus for controlling an image forming system, wherein the image forming system includes a transparent toner image forming device configured to form a transparent toner image on a sheet on which a color toner image has been fixed and includes a fixing device configured to fix the transparent toner image formed on the sheet, said control apparatus comprising:

an image obtaining portion constructed to obtain image information designated by a user for forming the transparent toner image on part of the sheet;

a color toner amount obtaining portion constructed to obtain a toner amount per unit area of the color toner image fixed on the sheet on which the transparent toner image is to be formed by the transparent toner forming device;

a controller constructed to control the transparent toner image forming device such that, when the color toner image is fixed in an amount not less than a predetermined first amount per unit area in a first region designated so as not to form the transparent toner image on the basis of the image information, the transparent toner image is formed in a predetermined second amount per unit area in the first region, and such that the transparent toner image is formed in an amount not less than the predetermined second amount per unit area in a second region designated so as to form the transparent toner image on the basis of the image information.

2. An apparatus according to claim 1, further comprising sheet type obtaining portion for obtaining the type of the sheet on which the transparent toner image is to be formed, wherein said controller changes at least one of the predetermined first amount and the predetermined second amount depending on the type of the sheet obtained by said sheet type obtaining portion.

3. An apparatus according to claim 1, wherein said controller controls the transparent image forming device so that the transparent toner image is formed as per the image information designated by the user at a portion where the amount of the color toner image fixed on the sheet is less than the predetermined first amount per unit area.

4. A control apparatus for controlling an image forming system, wherein the image forming system forms a transparent toner image on a sheet on which a color toner image has been fixed, said control apparatus comprising:

an information obtaining portion for obtaining image information designated by a user for forming the transparent toner image on part of the sheet;

a color toner amount obtaining portion for obtaining a toner amount per unit area of the color toner image fixed on the sheet on which the transparent toner image is to be formed by a transparent toner forming device;

an image information generating portion for generating changed image information such that, when the color toner image is fixed in an amount not less than a predetermined first amount per unit area in a first region designated so as not to form the transparent toner image on the basis of the image information, the transparent toner image is formed in a predetermined second amount per unit area in the first region; and an image information sending means for sending the image information generated by said image information generating portion to the image forming system.

5. A non-transitory computer-readable recording medium storing a program for causing an information processing apparatus to function as the control apparatus according to claim 4.

* * * * *